US012146259B2

(12) United States Patent
Hong et al.

(10) Patent No.: US 12,146,259 B2
(45) Date of Patent: Nov. 19, 2024

(54) CLOTHES CARE APPARATUS AND CONTROL METHOD THEREOF

(71) Applicant: Samsung Electronics Co., Ltd., Suwon-si (KR)

(72) Inventors: Jong Soo Hong, Suwon-si (KR); Jun Hoe Choi, Suwon-si (KR); Jeong Su Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 712 days.

(21) Appl. No.: 17/309,428

(22) PCT Filed: Nov. 18, 2019

(86) PCT No.: PCT/KR2019/015734
§ 371 (c)(1),
(2) Date: May 26, 2021

(87) PCT Pub. No.: WO2020/111616
PCT Pub. Date: Jun. 4, 2020

(65) Prior Publication Data

US 2022/0034023 A1 Feb. 3, 2022

(30) Foreign Application Priority Data

Nov. 30, 2018 (KR) ..... 10-2018-0152791

(51) Int. Cl.
*D06F 58/10* (2006.01)
*D06F 58/20* (2006.01)
(Continued)

(52) U.S. Cl.
CPC ..... *D06F 58/10* (2013.01); *D06F 58/203* (2013.01); *D06F 58/263* (2013.01); *D06F 58/30* (2020.02);
(Continued)

(58) Field of Classification Search
CPC ..... D06F 58/10; D06F 58/203; D06F 58/263; D06F 58/30; D06F 58/38; D06F 2103/04;
(Continued)

(56) References Cited

U.S. PATENT DOCUMENTS 7,610,779 B2 11/2009 Yang et al.
10,443,184 B2 10/2019 Park et al.
(Continued)

FOREIGN PATENT DOCUMENTS

JP 3702528 B2 10/2005
JP 2013-240497 A 12/2013
(Continued)

OTHER PUBLICATIONS

International Search Report and Written Opinion of the International Searching Authority dated Mar. 19, 2020 in connection with International Application No. PCT/KR2019/015734, 11 pages.
(Continued)

*Primary Examiner* — John P McCormack

(57) ABSTRACT

A clothes care apparatus according to a disclosed embodiment includes: a chamber; an upper fan provided on an upper side of the chamber and configured to move air in a lower side direction of the chamber; a lower fan provided on a lower side of the chamber and configured to move air in an upper side direction of the chamber; a first motor configured to rotate the lower fan; a steam generating device configured to generate steam by heating water; and a controller configured to control on/off of the steam generating device and the first motor and turn on the steam generating device in a first section for supplying the generated steam into the chamber and turn on the first motor in a second section for dispersing the steam by the air moving into the chamber.

14 Claims, 28 Drawing Sheets

(51) Int. Cl.

| | |
|---|---|
| ***D06F 58/26*** | (2006.01) |
| ***D06F 58/30*** | (2020.01) |
| ***D06F 58/38*** | (2020.01) |
| *D06F 103/04* | (2020.01) |
| *D06F 103/06* | (2020.01) |
| *D06F 103/34* | (2020.01) |
| *D06F 105/30* | (2020.01) |
| *D06F 105/56* | (2020.01) |

(52) U.S. Cl.
CPC ..... *D06F 58/38* (2020.02); *D06F 2103/04* (2020.02); *D06F 2103/06* (2020.02); *D06F 2103/34* (2020.02); *D06F 2105/30* (2020.02); *D06F 2105/56* (2020.02)

(58) Field of Classification Search
CPC ..... D06F 2103/06; D06F 2103/34; D06F 2105/30; D06F 2105/56; D06F 73/02; D06F 58/26; D06F 2105/58; D06F 35/00; F26B 9/00
USPC ..... 34/528
See application file for complete search history.

(56) References Cited

U.S. PATENT DOCUMENTS

2011/0214457 A1* 9/2011 Han ..... D06F 34/18 68/12.27
2012/0011738 A1* 1/2012 Ashrafzadeh ..... D06F 58/20 34/130
2014/0223973 A1* 8/2014 Alrefaei ..... A47G 25/14 223/51
2017/0350066 A1* 12/2017 Kim ..... D06F 73/02
2018/0066389 A1* 3/2018 Wu ..... G05B 19/048
2018/0087207 A1* 3/2018 Choi ..... D06F 23/04
2019/0257025 A1* 8/2019 Park ..... D06F 67/005

FOREIGN PATENT DOCUMENTS

| | | | |
|---|---|---|---|
| JP | 2014-217496 | A | 11/2014 |
| JP | 2018-102355 | A | 7/2018 |
| KR | 10-2005-0113317 | A | 12/2005 |
| KR | 10-2008-0109509 | A | 12/2008 |
| KR | 10-0893217 | B1 | 4/2009 |
| KR | 10-2009-0050619 | A | 5/2009 |
| KR | 10-2009-0100803 | A | 9/2009 |
| KR | 20-0472952 | Y1 | 5/2014 |
| KR | 10-2016-0039872 | A | 4/2016 |
| KR | 10-2017-0125855 | | 11/2017 |
| KR | 10-2017-0137503 | A | 12/2017 |
| KR | 10-2018-0045323 | A | 5/2018 |
| KR | 10-2018-0116037 | A | 10/2018 |

OTHER PUBLICATIONS

Notice of Preliminary Rejection dated Jul. 27, 2023, in connection with Korean Application No. 10-2018-0152791, 22 pages.

* cited by examiner

FIG. 20

| LOAD OF CLOTHES / TEXTURE OF CLOTHES | ONE PIECE | TWO PIECES | THREE PIECES |
|---|---|---|---|
| Soft | - | - | - |
| Midium | - | - | - |
| Hard | - | - | - |

CLOTHES CARE APPARATUS AND CONTROL METHOD THEREOF

CROSS-REFERENCE TO RELATED APPLICATIONS

This application is a 371 National Stage of International Application No. PCT/KR2019/015734, filed Nov. 18, 2019, which claims priority to Korean Patent Application No. 10-2018-0152791, filed Nov. 30, 2018, the disclosures of which are herein incorporated by reference in their entirety.

BACKGROUND

1. Field

The disclosure relates to a clothes care apparatus that removes dust attached to clothes or odor of clothes.

2. Description of Related Art

A clothes care apparatus is an apparatus that performs clothes care such as drying wet clothes, removing dust attached to clothes or odors permeated in clothes, and reducing wrinkles of clothes.

Since the clothes care is performed by supplying air or hot air generated from a blowing device to clothes or spraying steam generated from a steam generating device onto clothes, when a load or texture of clothes in the clothes care apparatus is identified, a control parameter applied to the blowing device or the steam generating device may be determined as an optimum value.

SUMMARY

Therefore, it is an object of the disclosure to provide a clothes care apparatus capable of estimating the load of clothes in the clothes care apparatus using an optical sensor and determining a control parameter applied to a blowing device or a steam generating device on the basis of the estimated load of the clothes, so that clothes care is efficiently performed and the time for the care is shortened, and a method of controlling the same.

It is another object of the disclosure to provide a clothes care apparatus capable of estimating the texture of clothes in the clothes care apparatus using an optical sensor, and determining a control parameter applied to a blowing device or a steam generating device on the basis of the estimated texture of the clothes, so that clothes care is efficiently performed and damage to the clothes is minimized, and a method of controlling the same.

According to an aspect of the disclosure, there is provided a clothes care apparatus including: a chamber configured to accommodate clothes; at least one hanger arranged in the chamber to mount the clothes thereon; an optical sensor including a light emitter and a light receiver; a blowing device configured to supply wind into the chamber; a steam generating device configured to supply steam into the chamber; and a controller configured to identify a load of clothes accommodated in the chamber on the basis of an output value of the optical sensor, determine a control parameter of at least one of the blowing device or the steam generating device on the basis of the load of the clothes, and control the at least one of the blowing device or the steam generating device on the basis of the determined control parameter.

The controller may identify a number of pieces of clothes accommodated in the chamber on the basis of an amount of light received by the light receiver.

The control parameter of the blowing device may include at least one of an air volume or an air blowing time.

The control parameter of the steam generating device may include at least one of a steam volume or a steam generating time.

The hanger may include a first hanger and a second hanger, and the optical sensor may include a first optical sensor provided to correspond to the first hanger and a second optical sensor provided to correspond to the second hanger.

The controller may identify whether clothes are hung on the first hanger on the basis of an output value of the first optical sensor, and identify whether clothes is hung on the second hanger on the basis of an output value of the second optical sensor.

The hanger may include a first hanger and a second hanger, and the light receiver may include a first light receiver arranged to correspond to the first hanger and a second light receiver arranged to correspond to the second hanger.

The controller may identify whether clothes are hung on the first hanger on the basis of an output value of the first light receiver, and identify whether clothes are hung on the second hanger on the basis of an output value of the second light receiver.

The light emitter and the light receiver may be arranged on an upper portion of the chamber, and a reflective film that reflects light may be attached to the hanger.

One of the light emitter and the light receiver may be arranged on an upper portion of the chamber, and a remaining one of the light emitter and the light receiver may be arranged on a lower portion of the chamber.

The controller may identify a texture of the clothes accommodated in the chamber on the basis of an amount of change in the output value of the optical sensor.

The controller may control the blowing device to supply wind into the chamber, and identify the texture of the clothes accommodated in the chamber on the basis of the amount of change in the output value of the optical sensor measured during the supply of the wind into the chamber.

The controller may determine a control parameter of at least one of the blowing device or the steam generating device according to the texture of the clothes, and control at least one of the blowing device or the steam generating device on the basis of the determined control parameter.

When a plurality of pieces of the clothes is accommodated in the chamber, the controller may identify the respective textures of the plurality of clothes.

The controller may determine a control of at least one of the blowing device or the steam generating device on the basis of a texture of clothes having the highest sensitivity among the textures of the plurality of pieces of the clothes.

The clothes care apparatus may further include a humidity sensor configured to detect the humidity in the chamber, and the controller may determine the control parameter of the blowing device including at least one of an air volume or an air blowing time air to be applied to a drying stroke on the basis of an output value of the humidity sensor The clothes care apparatus may further include a display, and the controller may control the display to display information about the determined air blowing time.

The controller, in response to the amount of change in the output value of the humidity sensor being less than a reference value, may terminate the drying stroke.

The controller, in response to the amount of change in the output value of the humidity sensor exceeding the reference value even after the determined air blowing time has elapsed, may extend the drying stroke.

The controller may display a first end point in time of the drying stroke for the air blowing time, determine a second end point in time of the drying stroke on the basis of a trend of the amount of change in the output value of the humidify sensor, and control the display to display the second end point in time on the basis of a difference between the first end point in time and the second end point in time.

The humidity sensor may be provided at an inner side of a door for opening and closing the chamber or at a lower side of the chamber.

The clothes care apparatus may further include a gas sensor configured to detect odor in the chamber, and the controller may determine the control parameter of the blowing device including at least one of an air volume or an air blowing time air to be applied to a deodorization stroke on the basis of an output value of the gas sensor.

The care apparatus may further include a display, and the controller may control the display to display information about the determined air blowing time.

The controller, in response to the amount of change in the output value of the gas sensor being less than a reference value, may terminate the deodorization stroke.

The controller, in response to the amount of change in the output value of the humidity sensor exceeding the reference value even after the determined air blowing time has elapsed, may extend the deodorization stroke.

The clothes care apparatus may further include a gas sensor configured to detect odor, and the controller, in response to the amount of change in the output value of the humidity sensor being less than a first reference value and the amount of change in the output value of the gas sensor being less than a second reference value, may terminate the drying stroke.

According to another aspect of the disclosure, there is provided a clothes care apparatus including: a chamber configured to accommodate clothes; at least one hanger arranged in the chamber on which the clothes is; an optical sensor including a light emitter and a light receiver; a blowing device configured to supply wind into the chamber; a steam generating device configured to supply steam into the chamber; and a controller configured to identify a texture of clothes accommodated in the chamber on the basis of an output value of the optical sensor, determine a control parameter of at least one of the blowing device or the steam generating device on the basis of the texture of the clothes, and control the at least one of the blowing device or the steam generating device on the basis of the determined control parameter.

The controller may control the blowing device to supply wind into the chamber, and on the basis of the amount of change in the output value of the optical sensor measured during the supply of the wind into the chamber, may identity the texture of the clothes accommodated in the chamber.

The hanger may include a first hanger and a second hanger, and the light receiver may include a first light receiver unit arranged to correspond to the first hanger and a second light receiver arranged to correspond to the second hanger.

The controller may identify the texture of the clothes mounted on the first hanger on the basis of an output value of the first light receiver, and identify the texture of the clothes mounted on the second hanger on the basis of an output value of the second light receiver.

The controller may control the control parameter of at least one of the blowing device or the steam generating device on the basis of a texture of clothes having the highest sensitivity among the texture of clothes mounted on the first hanger and the texture of the clothes mounted on the second hanger.

The clothes care apparatus may include: a first weight sensor configured to detect a weight of the first hanger; and a second weight sensor configured to detect a weight of the second hanger, and the controller may determine a load of clothes accommodated in the chamber on the basis of an output value of the first weight sensor and an output value of the second weight sensor.

According to an aspect of the disclosure, there is provided a method of controlling a clothes care apparatus, the method including: identifying a load of clothes accommodated in a chamber on the basis of an output value of an optical sensor; determining at least one of a control parameter of a blowing device for supplying wind into the chamber or a control parameter of a steam generating device for supplying steam into the chamber on the basis of the load of the clothes; and controlling the at least one of the blowing device or the steam generating device on the basis of the determined at least one of the control parameter of the blowing device or the control parameter of the steam generating device.

The method may further include: controlling the blowing device to supply air into the chamber; and identifying a texture of the clothes accommodated in the chamber on the basis of an amount of change in the output value of the optical sensor.

The determining of the at least one of the control parameter of the blowing device or the control parameter of the steam generating device may include determining at least one of the control parameter of the blowing device or the control parameter of the steam generating device on the basis of the load of the clothes and the texture of the clothes.

As is apparent from the above, the clothes care apparatus and the method of controlling the same estimate the load of clothes in the clothes care apparatus using an optical sensor and determine a control parameter applied to a blowing device or a steam generating device on the basis of the estimated load of the clothes, so that clothes care can be efficiently performed and the time required for the care can be shortened.

In addition, the clothes care apparatus and the method of controlling the same estimate the texture of clothes in the clothes care apparatus using an optical sensor, and determine a control parameter applied to a blowing device or a steam generating device on the basis of the estimated texture of the clothes, so that clothes care can be performed efficiently and damage to the clothes can be minimized.

BRIEF DESCRIPTION OF THE DRAWINGS

FIG. 20 is a control block diagram illustrating a clothes care apparatus further including a weight sensor.

DETAILED DESCRIPTION

Figure 1:
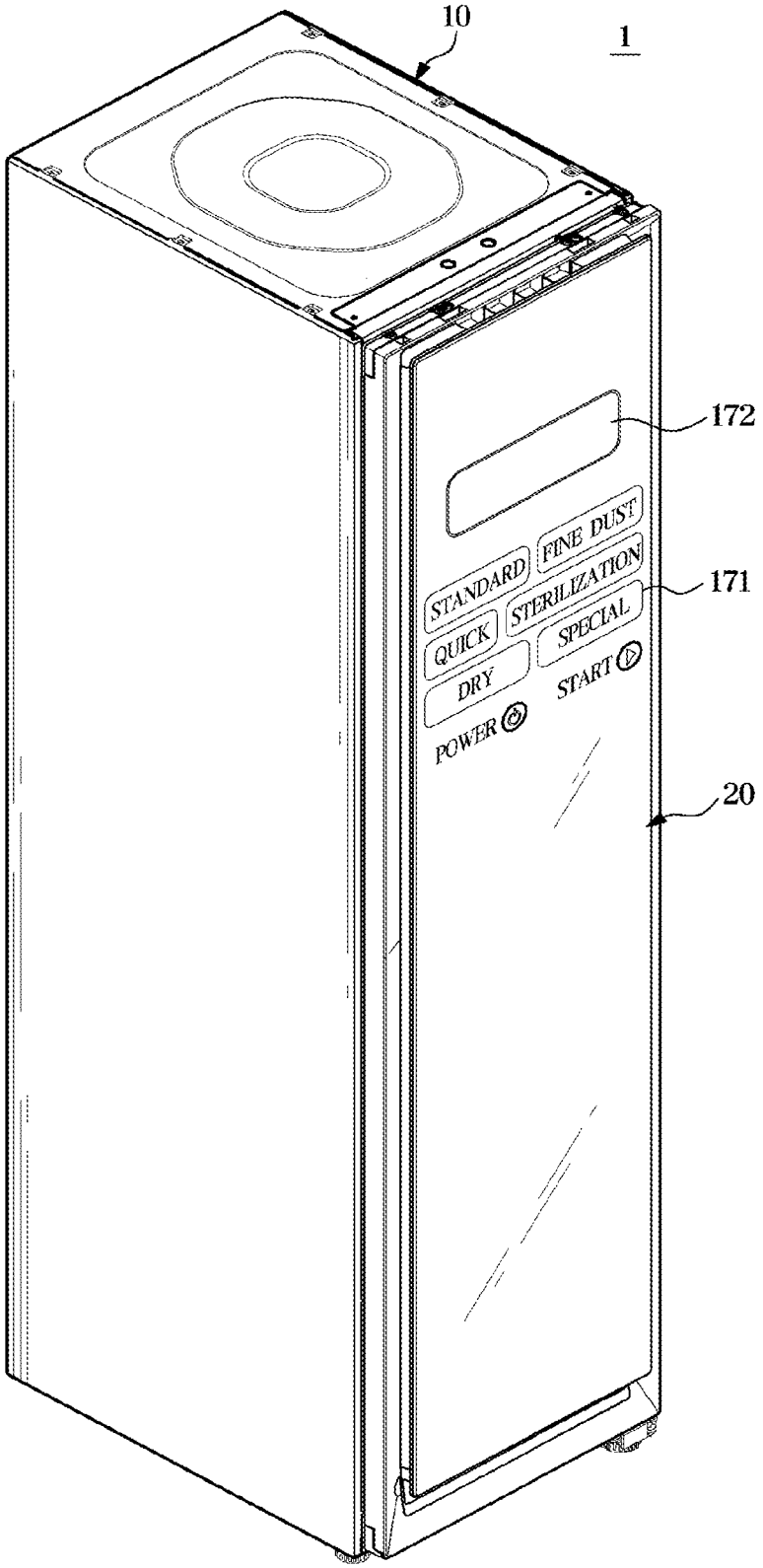
FIG. 1 is a perspective view illustrating an external appearance of a clothes care apparatus according to an embodiment.

Like numerals refer to like elements throughout the specification. Not all elements of embodiments of the present disclosure are described. A description of what are commonly known in the art or what overlap each other in the embodiments is omitted. The terms as used throughout the specification, such as "~part", "~module", "~member", "~block", and the like, may be implemented in software and/or hardware. A plurality of "~parts", "~modules", "~members", or "~blocks" may be implemented in a single element, or a single "~part", "~module", "~member", or "~block" or may include a plurality of elements.

It should be further understood that the term "connect" or its derivatives refer both to direct and indirect connection. The indirect connection includes a connection over a wireless communication network.

It should be further understood that the terms "comprises" and/or "comprising," when used in this specification, identify the presence of stated features, integers, steps, operations, elements, and/or components, but do not preclude the presence or addition of one or more other features, integers, steps, operations, elements, components, and/or groups thereof, unless the context clearly indicates otherwise.

Although the terms "first," "second," "A," "B," etc. may be used to describe various components, the terms do not limit the corresponding components, but are used only for the purpose of distinguishing one component from another component.

In addition, when terms, such as a reference value, a predetermined value, a predetermined time, and the like are used a plurality of times in an embodiment to be described below, it should be understood that the same terms used multiple times may not have the same value, and whether or not they have the same value may be determined based on each context in which the term is used.

As used herein, the singular forms "a," "an" and "the" are intended to include the plural forms as well, unless the context clearly indicates otherwise.

Reference numerals used for method steps are just used for convenience of explanation, but not to limit an order of the steps. Thus, unless the context clearly dictates otherwise, the written order may be practiced otherwise.

Meanwhile, the disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a computer-readable recording medium.

The computer-readable recording medium includes all kinds of recording media in which instructions which may be decoded by a computer are stored, for example, a Read Only Memory (ROM), a Random Access Memory (RAM), a magnetic tape, a magnetic disk, a flash memory, an optical data storage device, and the like.

Hereinafter, embodiments of a clothes care apparatus and a method of controlling the same will be described in detail with reference to the accompanying drawings.

Figure 2:
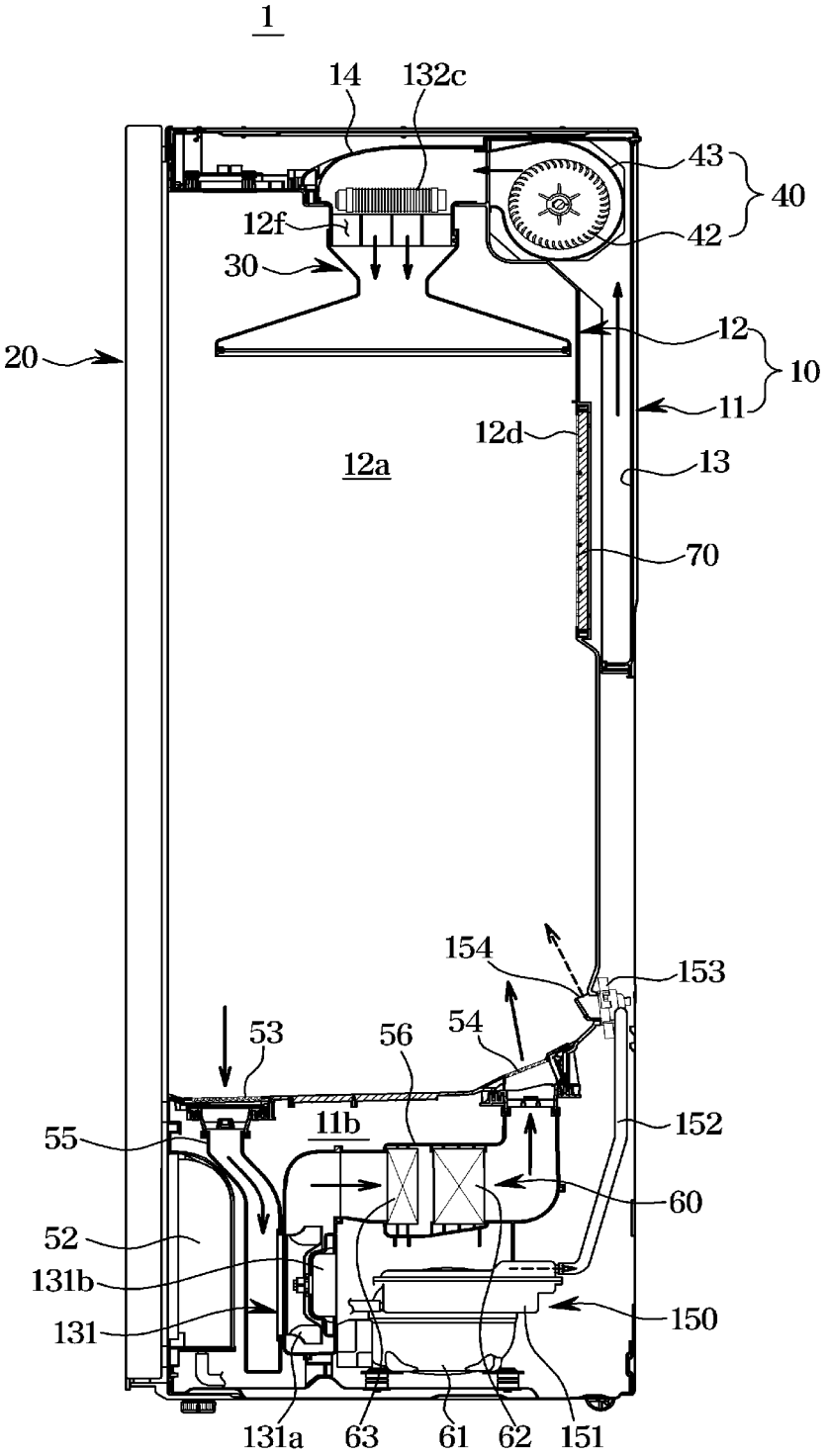
FIG. 2 is a side cross-sectional view illustrating a clothes care apparatus according to an embodiment.

FIG. 1 is a perspective view illustrating an external appearance of a clothes care apparatus according to an embodiment, and FIG. 2 is a side cross-sectional view illustrating a clothes care apparatus according to an embodiment.

In the embodiment to be described below, a direction in which a door 20 of a clothes care apparatus 1 is arranged to face is defined as forward and the opposite direction is defined as backward.

Referring to FIGS. 1 and 2, the clothes care apparatus 1 includes a main body 10, a chamber 12*a* provided inside the main body 10 to accommodate clothes, a door 200 rotatably coupled to the main body 10 to open and close the chamber 12*a*, and a hanger 30 provided inside the chamber 12*a* to mount clothes thereon.

The door 20 is provided at an outer side thereof, that is, a front surface of the clothes care apparatus 1, with an inputter 171 to receive a control command for the clothes care apparatus 1 from a user and a display 172 to display a screen for guiding a user's input or a screen for displaying information about an operation of the clothes care apparatus 1.

For example, the inputter 171 may be provided in the form of a button that receives an input through a pressed manipulation or a touch panel that receives an input through a touch manipulation. When the inputter 171 is provided in the form of a touch panel, the inputter 171 may be coupled to the display 172 to implement a touch screen.

The main body 10 may include an outer frame 11, an inner frame 12 arranged at an inner side of the outer frame 11, and upper ducts 13 and 14 arranged between the outer frame 11 and the inner frame 12 to guide air to be circulated.

The inner frame 12 may divide the chamber 12*a* from a machine room 11*b*. A heat exchanger 60 constituting a refrigeration cycle may be arranged in the machine room 11*b*. The heat exchanger 60 may accommodate a compressor 61, heat exchangers 62 and 63, and an expansion valve (not shown). The heat exchangers 62 and 63 may include a condenser 62 and an evaporator 63.

In addition, the machine room 11*b* may be provided with a lower blowing device 131 that suctions air to be supplied into the machine room 11*b* and introduces air into the chamber 12*a*.

The lower blowing device 131 may include a lower motor 131*b* generating a rotational force and a lower fan 131*a* provided to be rotated by the lower motor 131*b*. For example, the lower fan 131*a* may be provided as a centrifugal fan that suctions air in the axial direction and discharges air in the radially outward direction, but the embodiment of the clothes care apparatus 1 is not limited thereto, and other types of fans may also be used.

In addition, although the lower fan 131*a* is illustrated as a single unit in FIG. 2, a plurality of the lower fans may be provided according to design.

An upper surface of the machine room 11*b*, that is, a lower surface of the chamber 12*a*, is formed with a second inlet port 53, a second outlet port 54, and a steam discharge port 154. The second inlet port 53 may be arranged in a front portion of the lower surface of the chamber 12*a*, and the second outlet port 54 and the steam discharge port 184 may be arranged in a rear portion of the lower surface of the chamber 12*a*. The arrangement of the second inlet port 53, the second outlet port 54, and the steam discharge port 154 may be changed.

The machine room 11*b* may be provided with lower ducts 55 and 56 provided to guide air suctioned by the lower fan 131*a*. Air inside the chamber 12*a* may be introduced into the first lower duct 55 through the second inlet port 53. One end of the first lower duct 55 may be connected to the second inlet port 53, and the other end of the first lower duct 55 may be connected to the lower fan 131*a* of the lower blowing device 131. Air introduced into the first lower duct 55 may move to the second lower duct 56 through the lower fan 131*a*.

Inside the second lower duct 56, the evaporator 63 and the condenser 62 of the heat exchanger 60 may be arranged. In addition, the machine room 11*b* may accommodate the compressor 61 of the heat exchanger 60. For example, the compressor 61 may be an inverter compressor capable of changing the number of rotations or compression capacity. The inverter compressor may change the compression capacity through control of the number of rotations, and thereby control the amount of heat generated by the condenser 62.

The evaporator 63 may absorb heat from the air of the second lower duct 56. Moisture in the air is condensed while passing through the evaporator 63, and the condensed water may be stored in a drain container through a predetermined path.

The condenser 62 may be arranged downstream of the evaporator 63 in a passage of air. The air, of which humidity is lowered while passing through the evaporator 63, is heated while passing through the condenser 62. Air passing through the evaporator 63 and the condenser 62 is subject to increase in the temperature and decrease in the humidity. The high-temperature dry air may be introduced into the chamber 12*a* through the second outlet port 54.

That is, the heat exchanger 60 may remove moisture in the air flown by the lower fan 131*a* using the condenser 62 and the evaporator 63 arranged in the second lower duct 56. Accordingly, high-temperature dry air may be discharged through the second outlet port 54. With such a process, the inside of the chamber 12*a* may be dehumidified and clothes may be dried.

In addition, the machine room 11*b* may accommodate a steam generating device 150. The steam generating device 150 generates steam and supplies the generated steam to the chamber 12*a* to remove wrinkles and odors from clothes.

The steam generating device 150 may include a steam generator 151 for receiving water from a water supply container and generating steam, and a steam supply pipe 152 for guiding the generated steam to a steam jetting portion 153. The steam jetting portion 153 may be arranged in a lower portion of a rear surface of the chamber 12*a*.

The steam generator 151 is provided at an inside thereof with a heater that heats water.

The steam generated by the steam generating device 150 may be moved to the steam jetting portion 153 through the steam supply pipe 152 and may be supplied to the chamber 12*a* through the steam discharge port 154. In this case, the steam discharge port 154 may be arranged in a lower portion of the rear surface of the chamber 12*a* and may be arranged above the second outlet port 54.

An upper blowing device 132 may be provided on the upper side of the chamber 12*a*, and include an upper motor (not shown) generating a rotational force, a pair of upper fans 132*a* provided to be rotated by the upper motor, and a pair of fan cases 132*b* provided to accommodate the pair of upper fans 132*a*.

The upper motor is provided with a shaft that protrudes in both sides and has both side ends to which the upper fans 132*a* are coupled, respectively. Such a configuration allows the one upper motor to rotate the pair of upper fans 132*a*.

The pair of upper fans 132*a* may be provided as centrifugal fans that suction air in the axial direction and discharge air in the radially outward direction, but the embodiment of the clothes care apparatus 1 is not limited thereto, and other types of fans may be used.

In addition, although the upper fan 132*a* is illustrated as a single unit in FIG. 2, a plurality of the upper fans may be provided according to design.

The pair of fan cases 132*b* is provided on the both sides thereof with suction ports (not shown) and on the front side thereof with a discharge port (not shown) such that air suctioned from the both sides is guided to the front side.

The chamber 12*a* is provided at a rear surface thereof with a first inlet 12*d* formed to allow air in the chamber 12*a* to be introduced into the upper ducts 13 and 14. The first inlet 12*d* may be provided with a filter module 70. The filter module 70 may include a dust filter that collects dust and an odor decomposition filter that decomposes odor particles.

The chamber 12*a* is provided at an upper surface thereof with a first discharge port 12*f* formed to allow air of the upper ducts 13 and 14 to be discharged into the chamber 12*a*.

As the upper fan 132*a* rotates, air inside the chamber 12*a* may be introduced into the first upper duct 13 through the first inlet 12*d*. When the air inside the chamber 12*a* flows into the first upper duct 13, foreign substances, such as fine dust, existing in the air inside the chamber 12*a* may be removed by the dust filter of the filter module 70, and odor particles existing in the air inside the chamber 12*a* may be decomposed by the odor decomposition filter.

Air introduced into the first upper duct 13 may move upward along the first upper duct 13 to thereby be suctioned into the upper fan 132*a*. The air discharged from the upper fan 132*a* may be moved along the second upper duct 14 and may be introduced into the chamber 12*a* through the first discharge port 12*f* provided in the upper surface of the chamber 12*a*.

That is, the first upper duct 13 is installed to have a lower end connected to the lower portion of the rear surface of the chamber 12*a* and an upper end covering the upper blowing device 132. The second upper duct 14 is installed to have a rear end connected to the upper blowing device 132 and a front end covering an outer upper surface of the chamber 12*a* to thereby be connected to the first discharge port 12*f*.

The first discharge port 12*f* may include a first internal discharge port (not shown) for discharging air into the inside of the hanger 30 and a first external discharge port (not shown) provided at both sides of the first internal discharge port to discharge air to both sides of clothes mounted on the hanger 30.

When a plurality of the hangers 30 are provided in the chamber 12*a*, the first discharge port 12*f* may be formed for each of the plurality of hangers 30, and air discharge may be individually controlled for each hanger 30.

The second upper duct 14 is provided at an inside with a heater 132*c* to heat air. As the air flown by the upper fan 132*a* passes through the heater 132*c*, hot air may flow into the chamber 12*a* through the first discharge port 12*f*. Although only the heater 132*c* is illustrated in FIG. 2, the clothes care apparatus 1 according to an embodiment may include a heat exchanger (not shown) provided to remove moisture in the air flown by the upper fan 132*a* instead of the heater 132*c*. In this case, the heat exchanger may include a compressor, a condenser, an evaporator, and other device.

Figure 3:
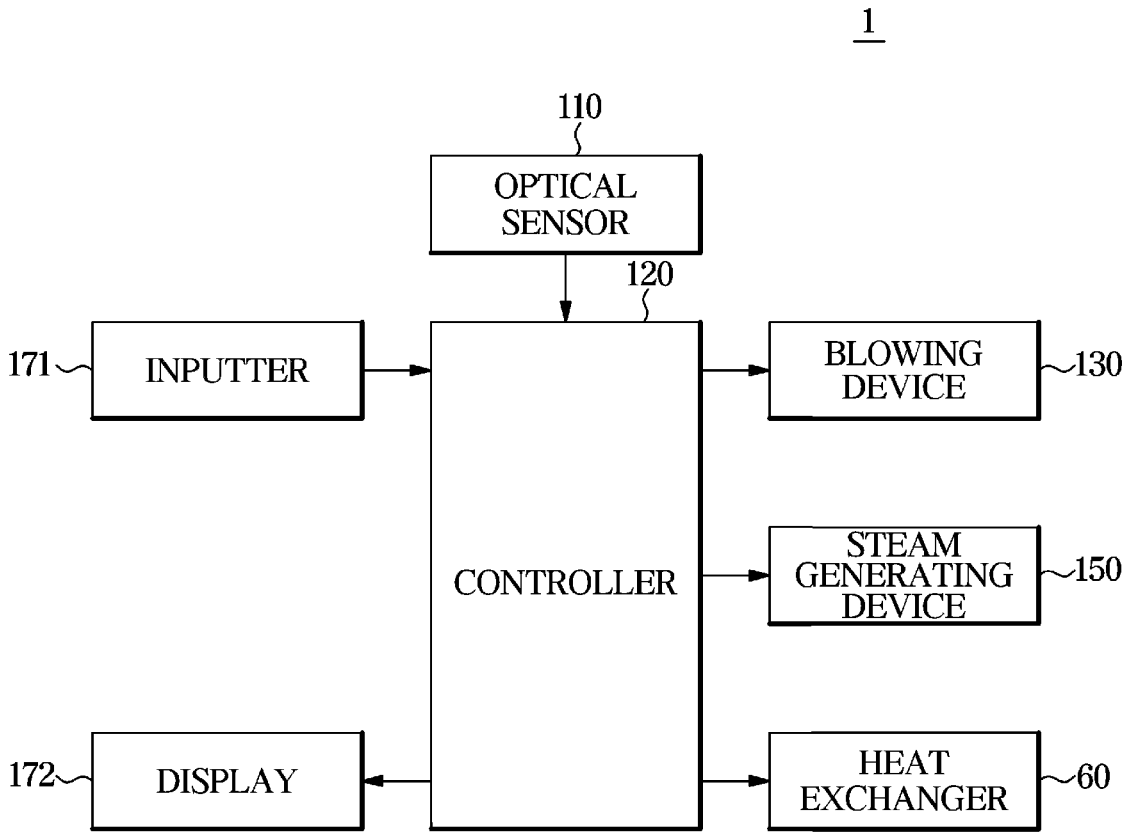
FIG. 3 is a control block diagram illustrating a clothes care apparatus according to an embodiment.
Figure 4:
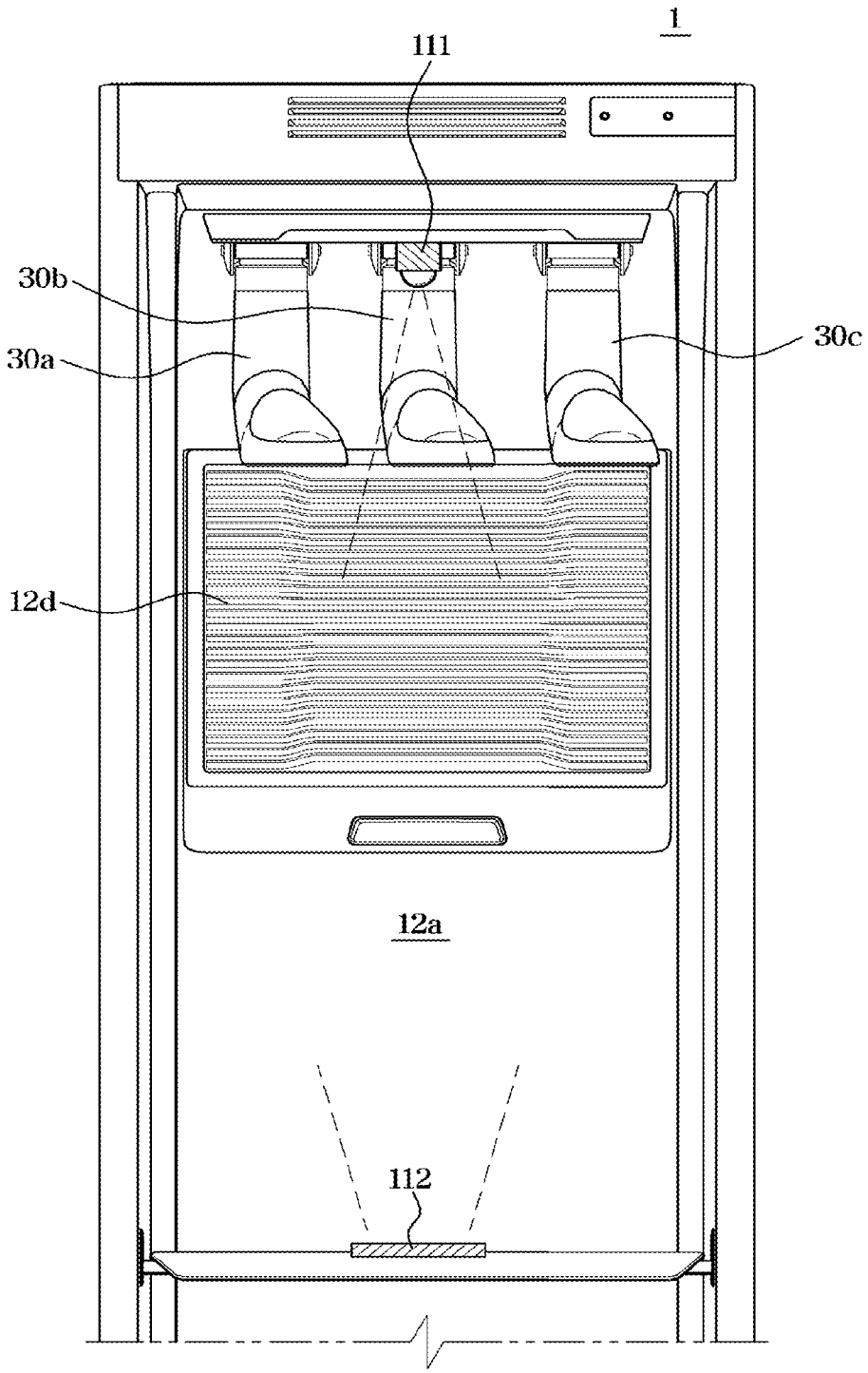
FIG. 4 is a diagram illustrating an example of arrangement of an optical sensor.
Figure 5:
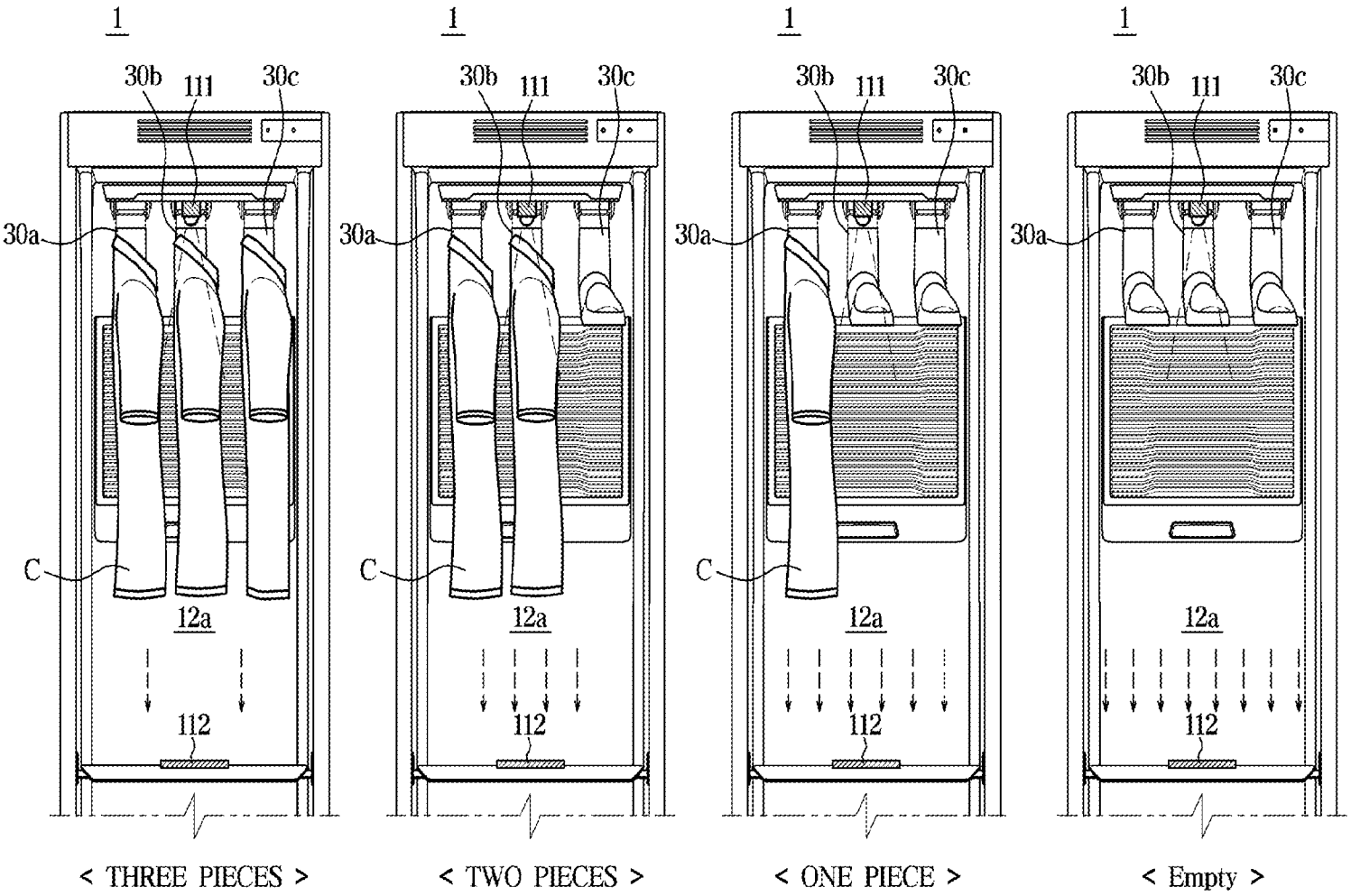
FIG. 5 is a diagram schematically illustrating the amount of light received by a light receiver according to a load of clothes.
Figure 6:
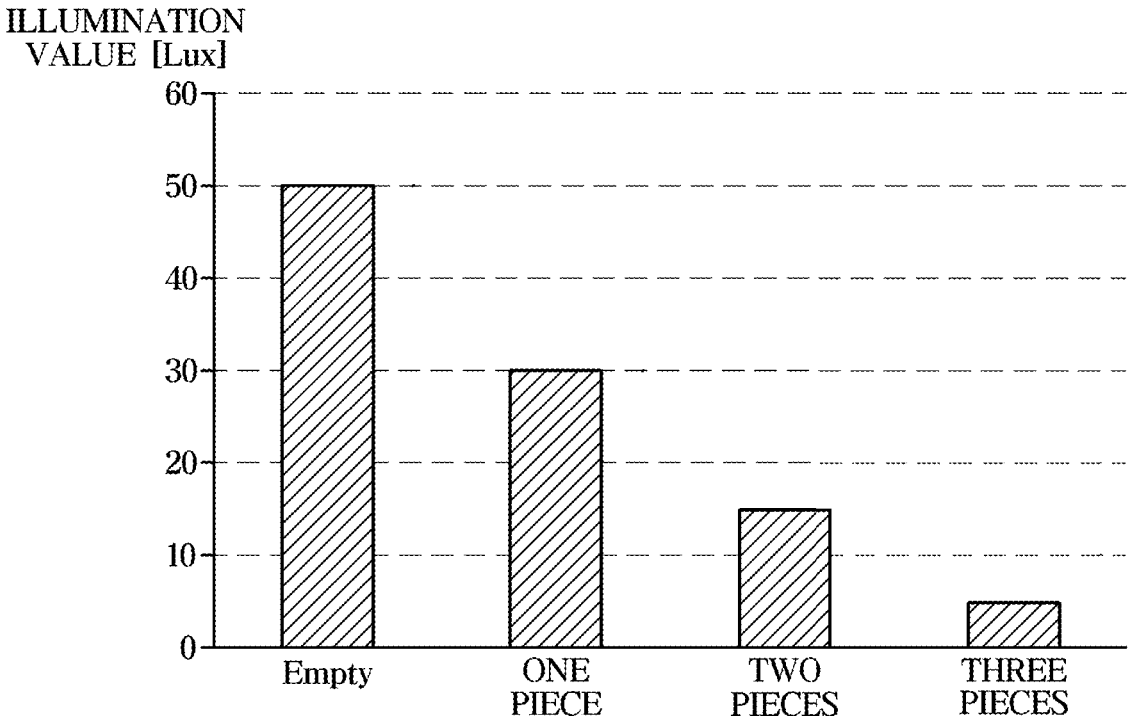
FIG. 6 is a graph showing an output value of an optical sensor according to a load of clothes.
Figure 7:
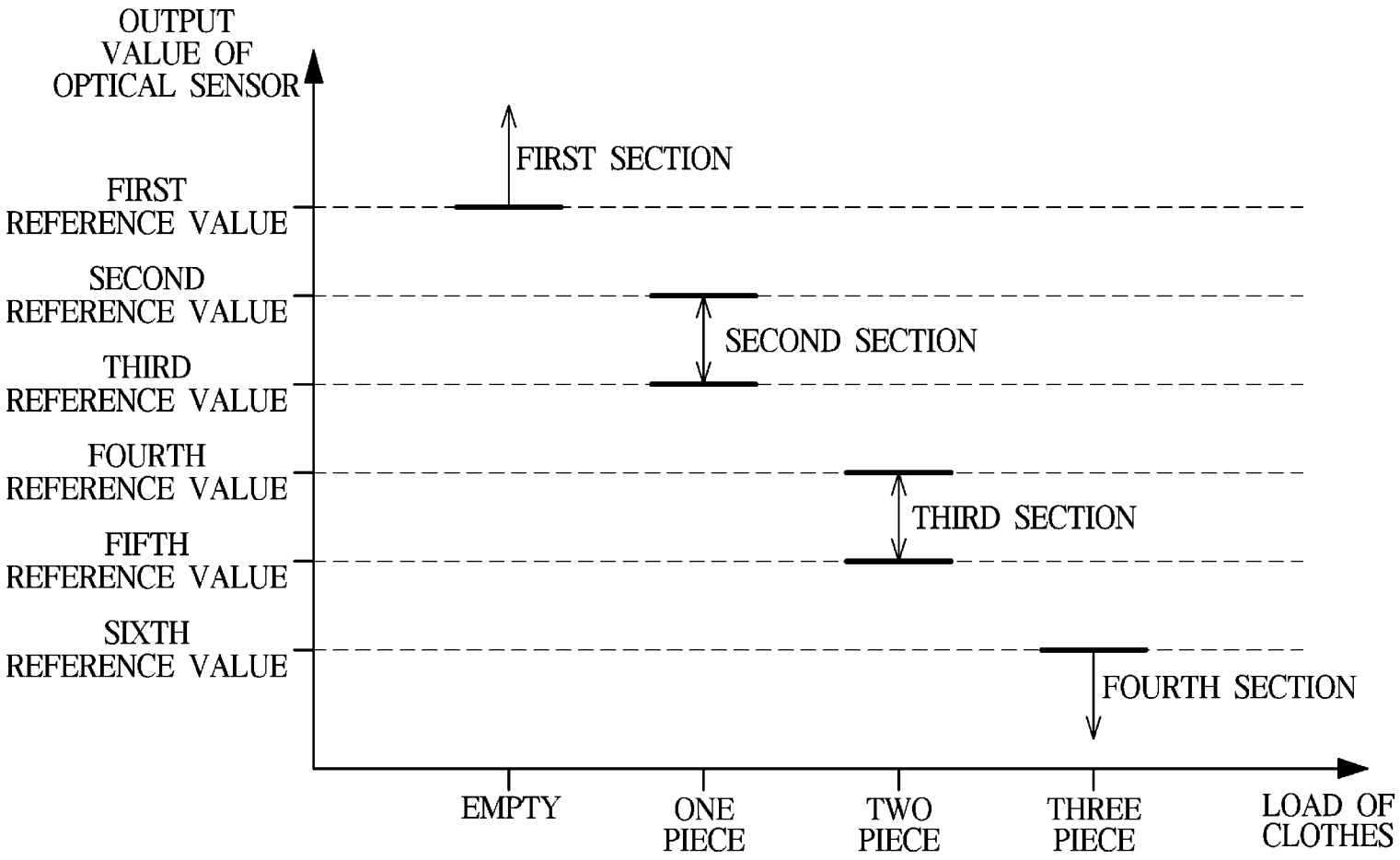
FIG. 7 is a diagram illustrating an example of information about a load of clothes that is stored for each output value of an optical sensor.

FIG. 3 is a control block diagram illustrating a clothes care apparatus according to an embodiment, FIG. 4 is a diagram illustrating an example of arrangement of an optical sensor, FIG. 5 is a diagram schematically illustrating the amount of light received by a light receiver according to the load of clothes, FIG. 6 is a graph showing an output value of an optical sensor according to the load of clothes, and FIG. 7 is a diagram illustrating an example of information about a load of clothes stored for each output value of an optical sensor.

Referring to FIG. 3, the clothes care apparatus 1 according to the embodiment includes an optical sensor 110, a blowing device 130 for supplying wind into the chamber 12*a*, a steam generating device 150 for supplying steam into the chamber 12*a*, and a controller 120 configured to identify a load of clothes accommodated in the chamber 12*a* on the basis of an output value of the optical sensor 110, determine a control parameter of at least one of the blowing device 130 or the steam generating device 150 on the basis of the load of the clothes, and control the at least one of the blowing device 130 or the steam generating device 150 on the basis of the determined control parameter.

In addition, the clothes care apparatus 1 may further include an inputter 171 for receiving a control command for the operation of the clothes care apparatus 1 from the user and a display 172 for displaying information about the operation of the clothes care apparatus 1.

In addition, the clothes care apparatus 1 may further include a heat exchanger 60 for supplying dried air into the chamber 12*a*, and the controller 120 may control the blowing device 130, the steam generating device 150, the display 172, and the heat exchanger 60. The controller 120 may control the blowing device 130, the steam generating device 150, the display 172, and the heat exchanger 60 on the basis of a control command input by a user through the inputter 171 or an output value of the optical sensor 110.

The controller 120 may include at least one memory for storing programs performing the above-described operations and operations described below and various pieces of data, and at least one processor for executing the stored programs.

When a plurality of the memories and the processors are provided, the memories and the processors may be integrated on a single chip or may be physically separated from each other. However, in the embodiment of the clothes care apparatus 1, there are no restrictions on the physical locations of the memory and the processor.

The optical sensor 110 is used to detect a load of clothes accommodated in the chamber 12*a*. Here, the load of clothes may represent the number of pieces of clothes or the volume of clothes.

Referring to the example of FIG. 4, the optical sensor 110 may include a light emitter 111 arranged on an upper side of the chamber 12*a* and a light receiver 112 arranged on a lower side of the chamber 12*a*. With such a structure, receives light emitted from the light emitter 111 is received by the light receiver 112, and the amount of light received by the light receiver 112 may vary depending on the load of clothes located between the light emitter 111 and the light receiver 112.

Referring to FIG. 5, clothes C accommodated in the chamber 12*a*, in more detail, each case of clothes mounted on the hanger 30 being three pieces of clothes, two pieces of clothes, one piece of clothes, and none (empty) leads to a different amount of light being received by the light receiver 112. The more pieces of clothes are accommodated, the more light from the light emitter 111 to the light receiver 112 is blocked, and the amount of light incident onto the light receiver 112 decreases.

Since the output value of the optical sensor 110 is proportional to the amount of light received by the light receiver 112, the output value (Lux) of the optical sensor 110 may vary depending on the number of pieces of clothes accommodated in the chamber 12*a*.

The controller 120 may store loads of clothes to correspond to output values of the optical sensor 110 in advance. For example, as shown in FIG. 7, the controller 120 may store a load of clothes that no clothes is accommodated in the chamber 12*a* when the output value of the optical sensor 110 is greater than or equal to a first reference value, that one piece of clothes is accommodated in the chamber 12*a* when the output value of the optical sensor 110 is less than a second reference value and greater than or equal to a third reference value, that two pieces of clothes are accommodated in the chamber 12*a* when the output value of the optical sensor 110 is less than a fourth reference value and greater than or equal to a fifth reference value, and that three pieces of clothes are accommodated in the chamber 12*a* when the output value of the optical sensor 110 is less than a sixth reference value.

The first reference value is larger than the second reference value, the third reference value is larger than the fourth reference value, and the fifth reference value is larger than the sixth reference value. In addition, a section greater than or equal to the first reference value may be defined as a first section, a section less than the second reference value and greater than or equal to the third reference value may be defined as a second section, a section less than the fourth reference value and great than or equal to the fifth reference value may be defined as a third section, and a section less than the sixth reference value may be defined as a fourth section.

The controller 120 may identify whether the output value of the optical sensor 110 is included in which one of the first to fourth sections, and determine a load corresponding to the section in which the output value of the optical sensor 110 is included as a load of clothes currently accommodated in the clothes care apparatus 1.

Alternatively, the load of clothes may be determined on the basis of the number of times the output value of the optical sensor 110 reaches a specific reference value during a predetermined time. For example, it may be determined that no clothes is accommodated in the chamber 12*a* when the output value of the optical sensor 110 reaches a first reference value a predetermined number of times during a predetermined time, that one piece of clothes is accommodated in the chamber 12*a* when the output value of the optical sensor 110 reaches a second reference value a predetermined number of times during a predetermined time, that two pieces of clothes are accommodated in the chamber 12*a* when the output value of the optical sensor 110 reaches a fourth reference value a predetermined number of times during a predetermined time, and that three pieces of clothes are accommodated in the chamber 12*a* when the output value of the optical sensor 110 reaches a sixth reference value a predetermined number of times during a predetermined time. Here, when the output value of the optical sensor 110 is referred to as reaching a reference value, the output value does not exceed the reference value, and the first reference value, the second reference value, the fourth reference value, and the sixth reference value may be the same as or different from the reference values described above that are used to define each section.

The load of clothes needs to be identified after the clothes is put into the chamber 12*a*. Accordingly, the point in time at which the controller 120 identifies the load of clothes may be at least one of: a point in time when the power of the clothes care apparatus 1 is turned on or later; a point in time when the door 20 is opened and then closed or later; or a point in time when a clothes care course is selected or an operation command is input or later.

Depending on the user or circumstance, powering on the clothes care apparatus 1 may be performed after insertion of clothes, or inserting clothes may be performed after powering on of the clothes care apparatus 1. Accordingly, the controller 120 may perform the identification of the load of clothes a plurality of times according to the power-on or the opening/closing of the door 20.

For example, the controller 120, in response to powering on, may primarily identify the load of clothes on the basis of the output value of the optical sensor 110, and in response to opening and closing of the door 20 being detected after the powering on, may determine that clothes are put in or taken out, and thus identify the load of clothes again on the basis of the output value of the optical sensor 110 measured after the door 20 is closed. The controller 120, in response to opening and closing of the door 20 not detected between powering on and selecting a clothes care course, may determine that input or removal of clothes has not been performed, and thus use the primarily identified load of clothes as it is.

Alternatively, the controller 120, in response to opening and closing of the door 20 not detected until a predetermined time elapses after the powering on, may identify the load of clothes after the predetermined time has elapsed, and in response to opening and closing of the door 20 being detected before the predetermined time elapses, may identify the load of clothes even when the predetermined time has not elapsed. In addition, even after identifying the load of clothes, the controller 120, in response to opening and closing of the door 20 being detected, may identify the load of clothes again on the basis of the output value of the optical sensor 110.

Alternatively, the identification of the load of clothes may be performed on the basis of the output value of the optical sensor 110 measured after a clothes care course is selected and an operation command is input, regardless of the opening and closing of the door 20.

FIGS. 8 to 12 are diagrams illustrating other examples of arrangement of an optical sensor applicable to a clothes care apparatus according to an embodiment.

Figure 8:
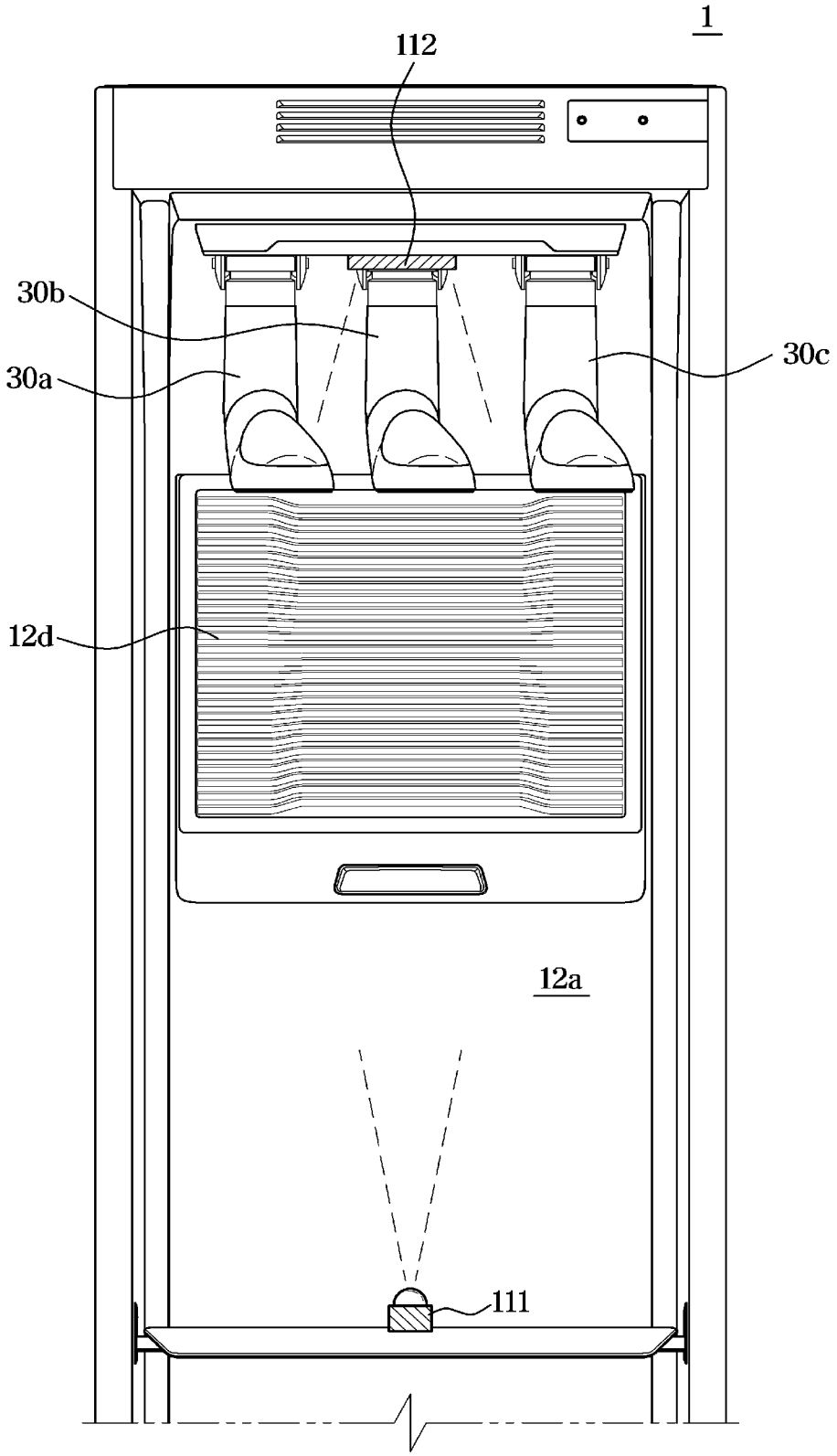
FIGS. 8 to 12 are diagrams illustrating other examples of arrangement of an optical sensor applicable to a clothes care apparatus according to an embodiment.

In FIG. 4 above, an example of the light emitter 111 arranged on the upper side of the chamber 12*a* and the light receiver 112 arranged on the lower side of the chamber 12*a* has been described. In the clothes care apparatus 1 according to an embodiment, the light emitter 111 may be arranged on the lower side of the chamber 12*a* and the light receiver 112 may be arranged on the upper side of the chamber 12*a* as illustrated in FIG. 8.

Figure 9:
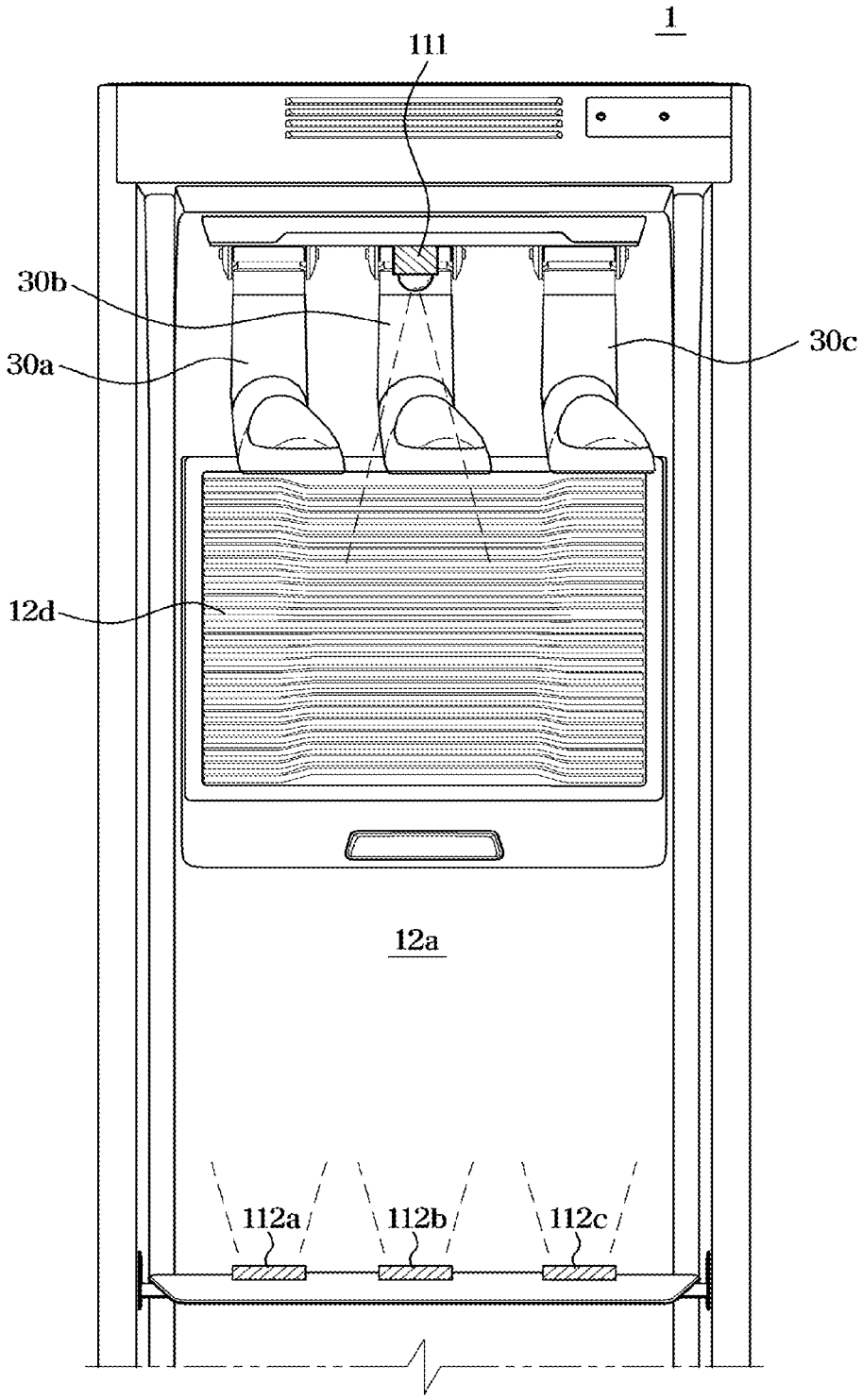
Figure 10:
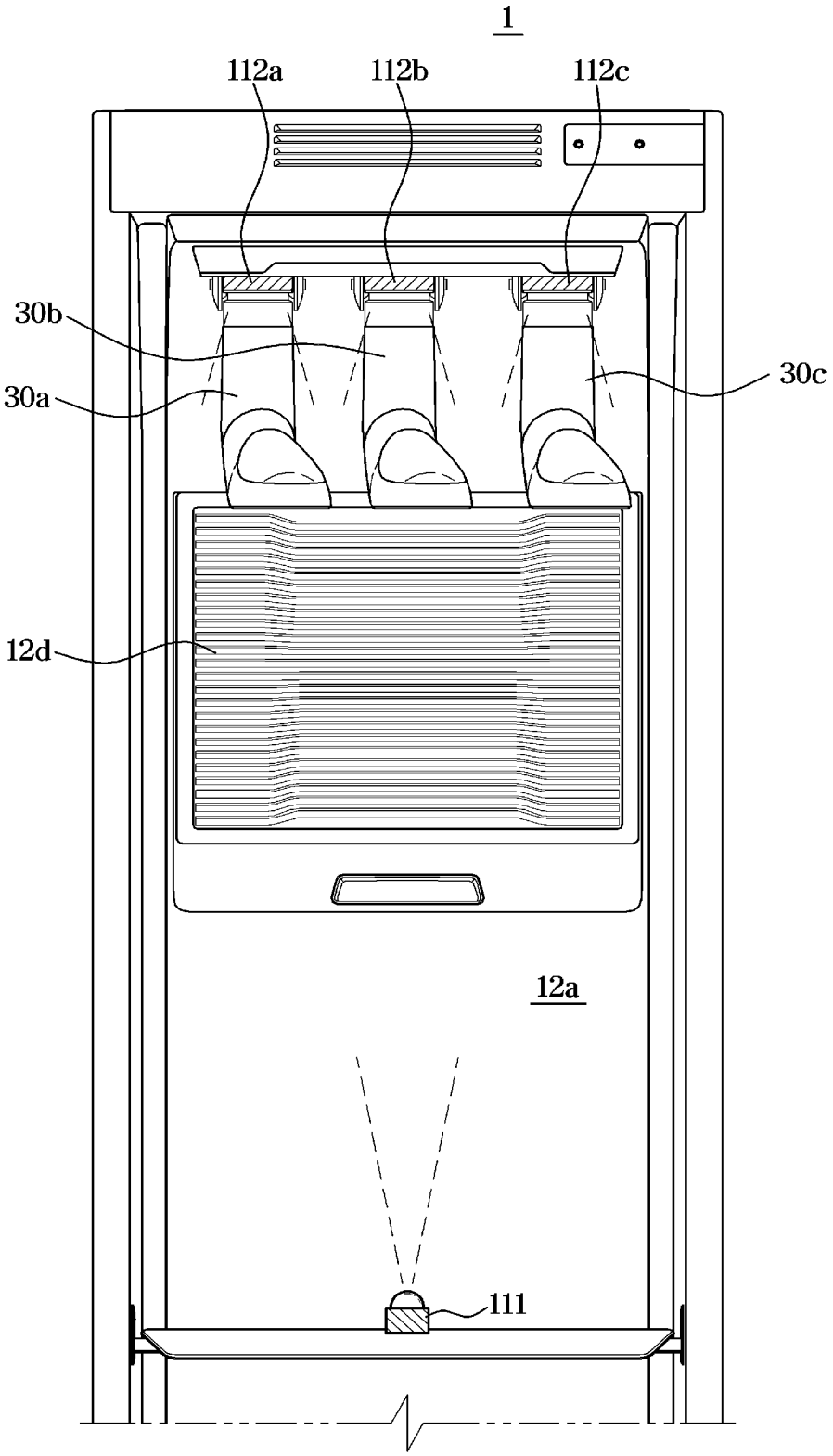

Alternatively, as illustrated in FIGS. 9 and 10, a plurality of the light receivers 112*a*, 112*b*, and 112*c* corresponding respectively to a plurality of hangers 30*a*, 30*b*, and 30*c* may be provided. Even in this case, the light emitter 111 may be arranged on the upper side of the chamber 12*a* (see FIG. 9), and the light receivers 112*a*, 112*b*, and 112*c* may be arranged on the upper side of the chamber 12*a* (see FIG. 10).

The first light receiver 112*a* corresponding to the first hanger 30*a* may be arranged at a position in which part or all of the optical path is blocked by clothes mounted on the first hanger 30*a*, the second light receiver 112*b* corresponding to the second hanger 30*b* may be arranged at a position in which part or all of the optical path is blocked by clothes mounted on the second hanger 30*b*, and the third light receiver 112*c* corresponding to the third hanger 30*c* may be arranged at a position in which part or all of the optical path is blocked by clothes mounted on the third hanger 30*c*.

Figure 11:
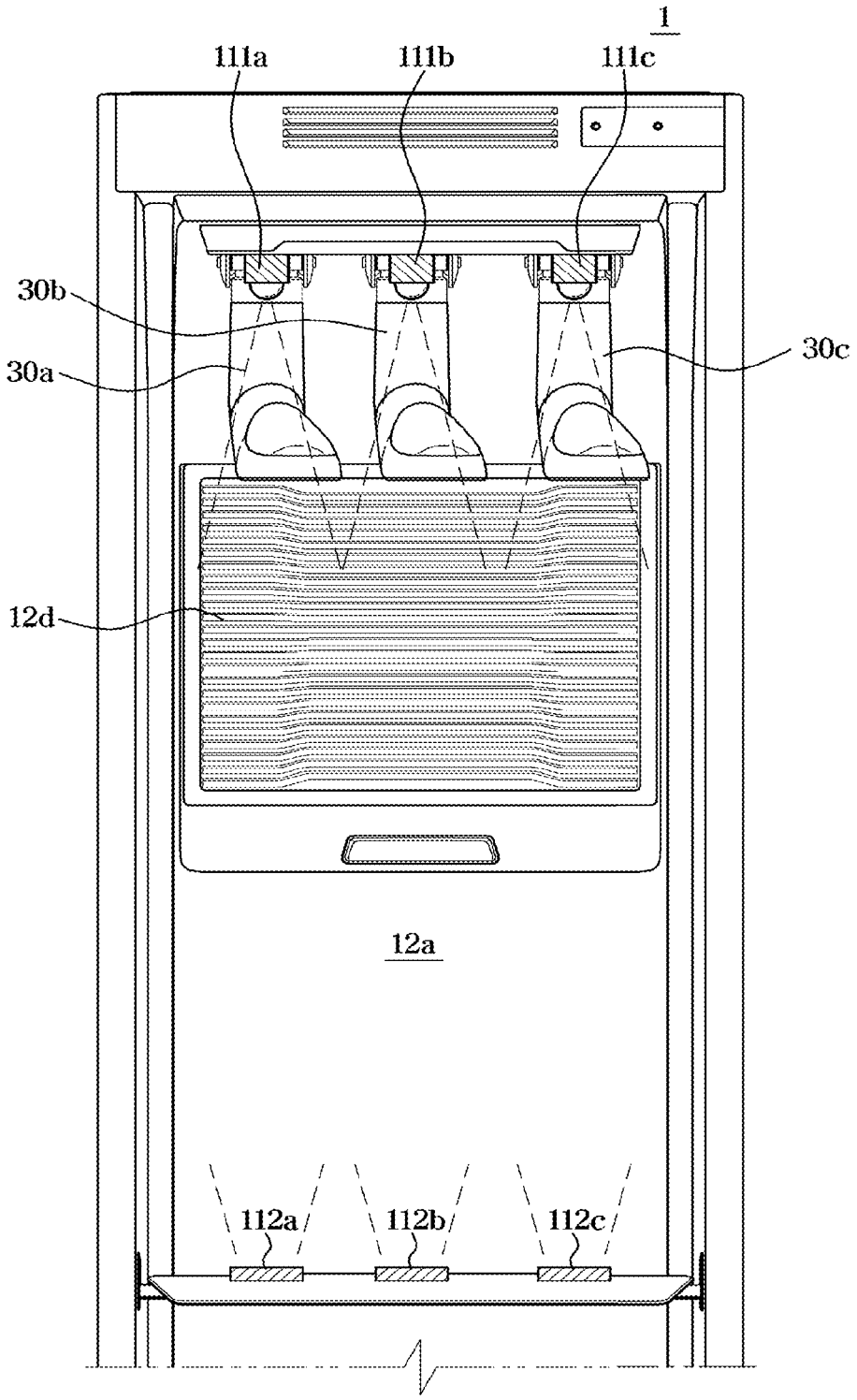
Figure 12:
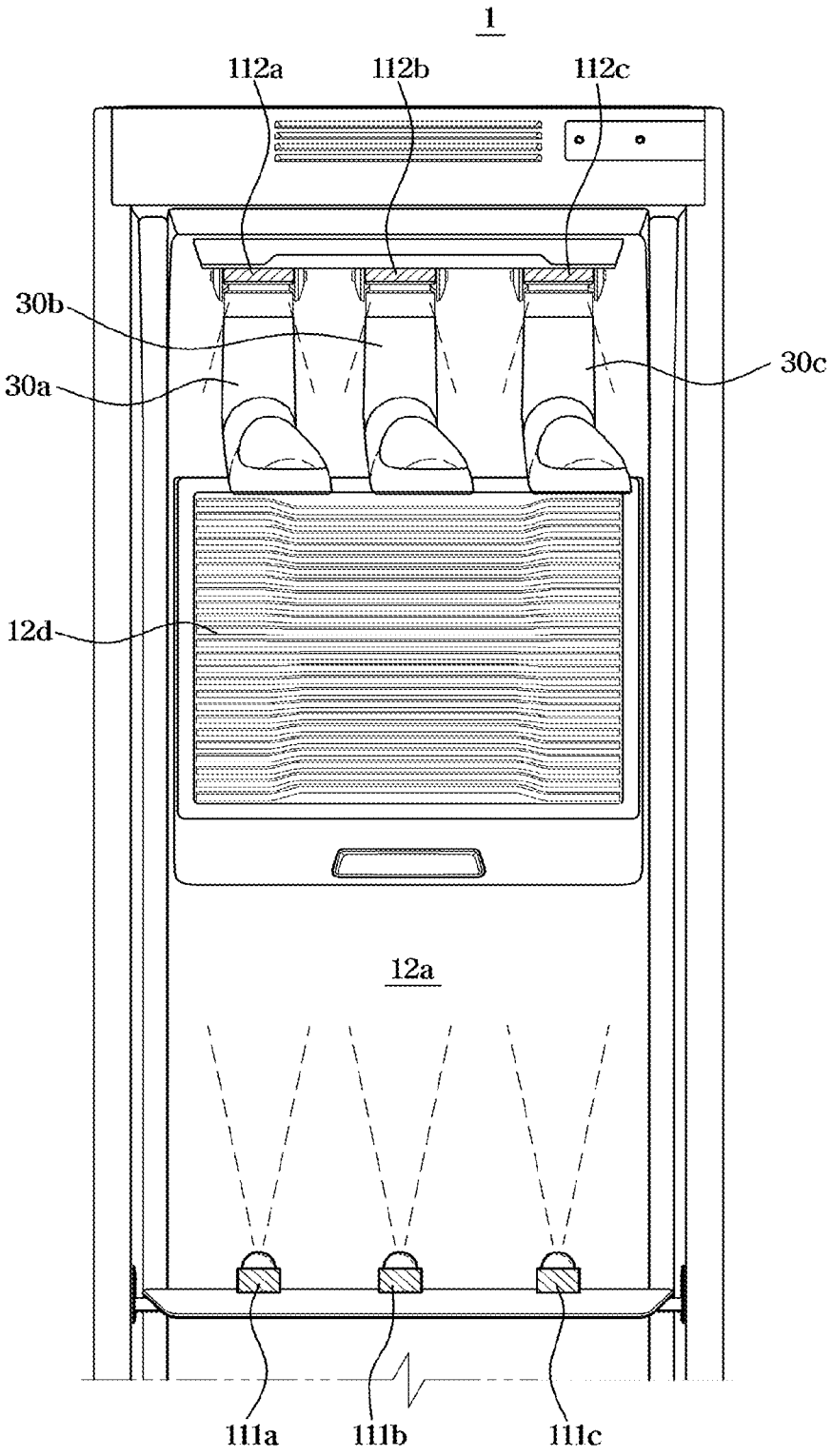

Alternatively, as illustrated in FIGS. 11 and 12, a plurality of light emitters 111*a*, 111*b*, and 111*c* and a plurality of light receivers 112*a*, 112*b*, and 112*c* corresponding respectively to a plurality of hangers 30*a*, 30*b*, and 30*c* may be provided. Even in this case, the light emitters 111*a*, 111*b*, and 111*c* may be arranged on the upper side of the chamber 12*a* (see FIG. 11), and the light receivers 112*a*, 112*b*, and 112*c* may be arranged on the upper side of the chamber 12*a* (see FIG. 12).

The controller 120 may identify whether clothes are hung on the first hanger 30*a* on the basis of the output value of the first light receiver 112*a*, identify whether clothes are hung on the second hanger 30*b* on the basis of the output value of the second light receiver 112*b*, and identify whether clothes are hung on the third hanger 30*c* on the basis of the output value of the third light receiver 112*c*.

Accordingly, the light receiver 112 provided for each hanger may provide more accuracy of identifying whether clothes are hung on each of the hangers 30*a*, 30*b*, and 30*c*.

Figure 13:
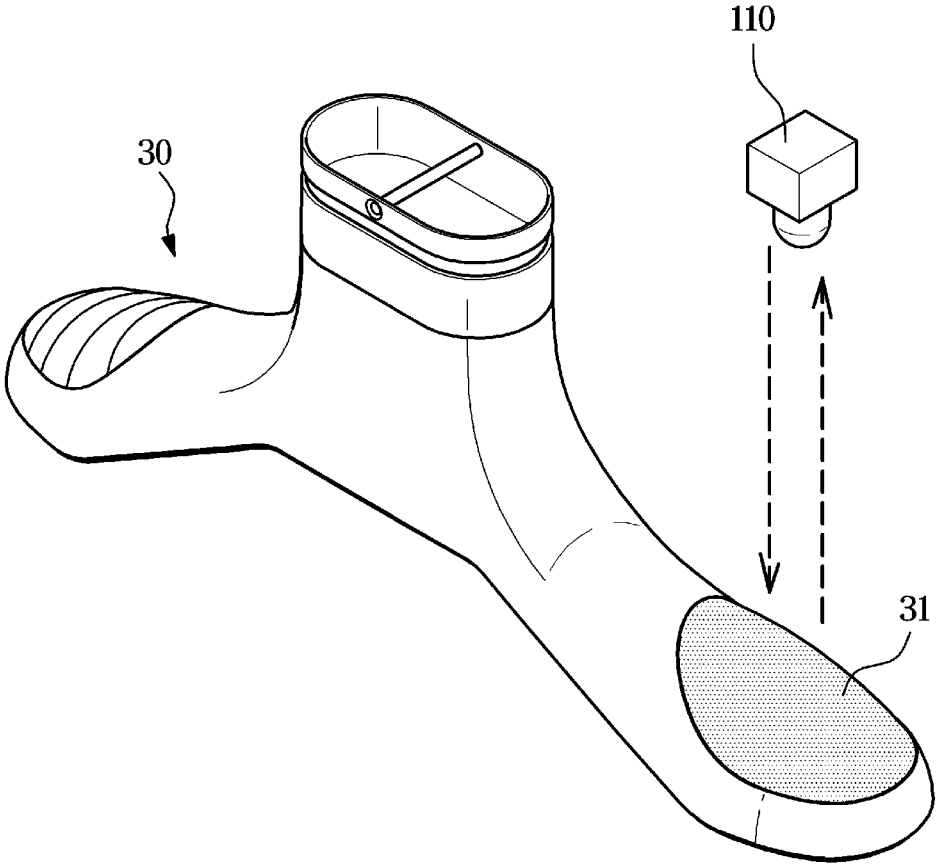
FIGS. 13 and 14 are diagrams illustrating other examples of an optical sensor applicable to a clothes care apparatus according to an embodiment.
Figure 14:
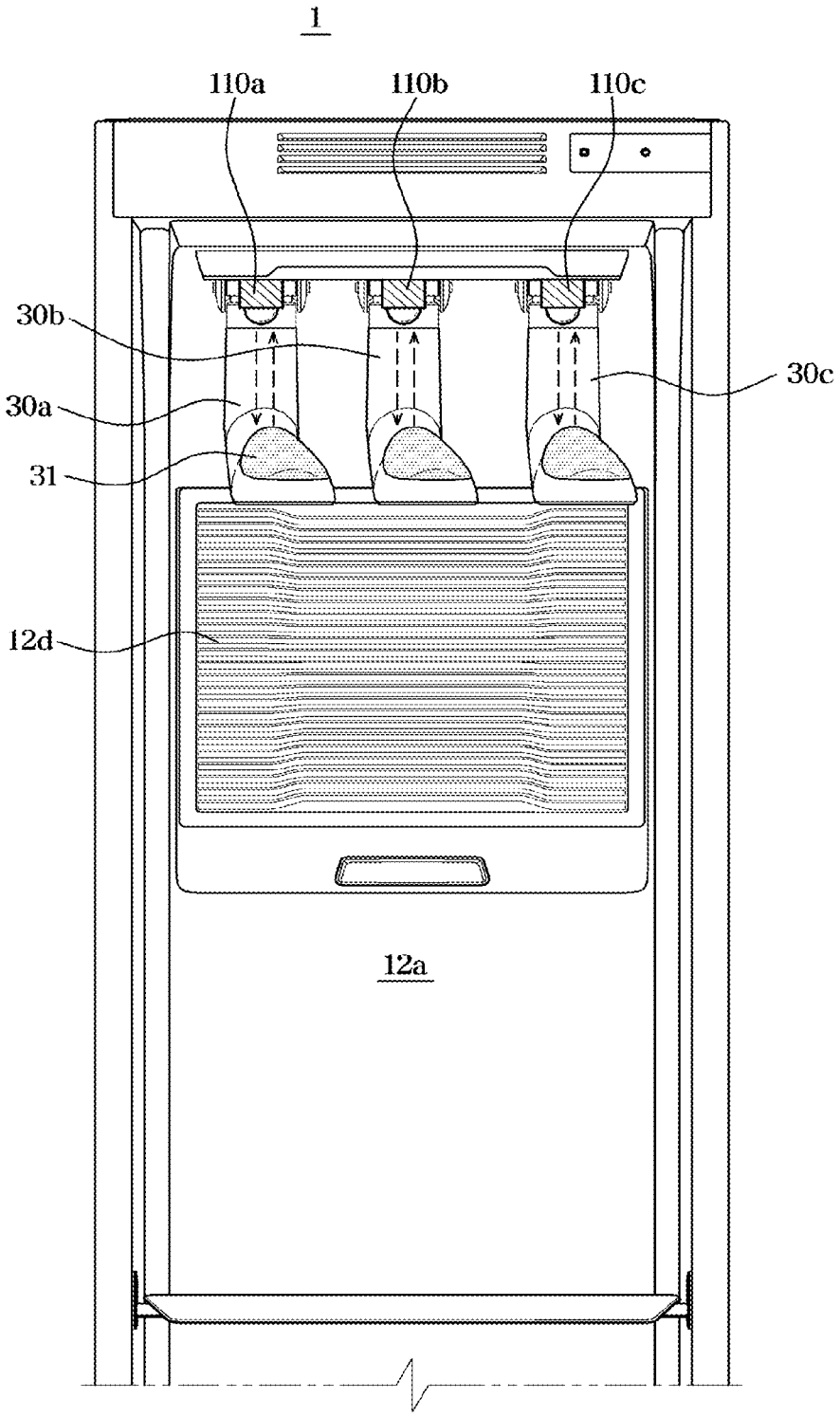

FIGS. 13 and 14 are diagrams illustrating other examples of an optical sensor applicable to a clothes care apparatus according to an embodiment.

In the above-described example, the light emitter 111 and the light receiver 112 of the optical sensor 110 are arranged to face each other. According to the example of FIG. 13, the light emitter 111 and the light receiver 112 may be arranged to face in the same direction, and the light receiver 112 may receive light emitted from the light emitter 111 and returning after being reflected on the hanger 30.

In order to increase the reflectance of light, a reflective film 31 reflecting light may be attached to the hanger 30. In particular, the reflective film 31 may be attached to a portion of the hanger 30 that is covered by clothes when the clothes are hung on the hanger 30.

The controller 120 may identify whether clothes are hung on the hanger 30 on the basis of the output value of the optical sensor 110. For example, a reference value for distinguishing whether or not clothes are hung on the hanger 30 may be stored in advance, and it may be determined that the clothes are hung in response to the output value of the optical sensor 110 being less than the reference value.

Referring to FIG. 14, the optical sensor 110 may be arranged on the upper side of the chamber 12*a*, in particular, a position corresponding to the reflective film 31 attached to the hanger 30, that is, a position allowing the optical sensor 110 transmitting light to the reflective film 31 to receives the light returning after being reflected on the reflective film 31.

In addition, a plurality of the optical sensors 110*a*, 110*b*, and 110*c* may be arranged for respective hangers 30*a*, 30*b*, and 30*c*, to individually identify whether clothes are hung on each hanger 30*a*, 30*b*, or 30*c*.

The controller 120 may identify whether clothes are hung on the first hanger 30*a* on the basis of the output value of the first optical sensor 110*a*, identify whether clothes are hung on the second hanger 30*b* on the basis of the output value of the second optical sensor 110*b*, and identify whether clothes are hung on the third hanger 30*c* on the basis of the output value of the third optical sensor 110*c*.

The controller 120 may determine a control parameter of the blowing device 130 on the basis of the load of the clothes identified on the basis of the output value of the optical sensor 110. In the embodiment to be described below, the control parameter of the blowing device 130 may be referred to as a blowing parameter.

The blowing parameter may include at least one of an air volume and an air blowing time. That is, the controller 120 may determine at least one of the air volume or the air blowing time on the basis of the load of the clothes. For example, as the load of the clothes is greater, the air volume and the air blowing time may be determined to be larger.

Alternatively, the controller 120 may fix the air blowing time to a value set according to the clothes care course, and may only determine the air volume.

The controller 120 may control the blowing device 130 according to the determined air volume or air blowing time. For example, the controller 120 may control the upper motor of the upper blowing device 132 or the lower motor 131*b* of the lower blowing device 131 according to the determined air volume and air blowing time.

In addition, the controller 120 may control the heat exchanger 60 according to the stroke in execution. For example, in a case of performing dehumidification or drying stroke by operating the heat exchanger 60, the controller 120 may control the number of rotations of the compressor 61 on the basis of the load of the clothes.

In addition, the controller 120 may determine a control parameter of the steam generating device 150 on the basis of the load of the clothes. In the embodiment to be described below, the control parameter of the steam generating device 150 may be referred to as a steam parameter.

The steam parameter may include at least one of a steam volume or a steam generation time. That is, the controller 120 may determine at least one of a steam volume or a steam generation time on the basis of the load of the clothes. For example, as the load of the clothes is greater, the steam volume and the steam generation time may be determined to be larger.

Alternatively, the controller 120 may fix the steam generation time to a value set according to the clothes care course, and may only determine the steam volume.

As such, the air blow and the steam generation are appropriately controlled according to the load of the clothes accommodated in the clothes care apparatus 1, so that clothes care may be efficiently performed and the time required for clothes care may be shortened.

Meanwhile, a texture of clothes accommodated in the clothes care apparatus 1 may be identified on the basis of the output value of the optical sensor 110. Hereinafter, embodiments related thereto will be described in detail with reference to the drawings.

Figure 15:
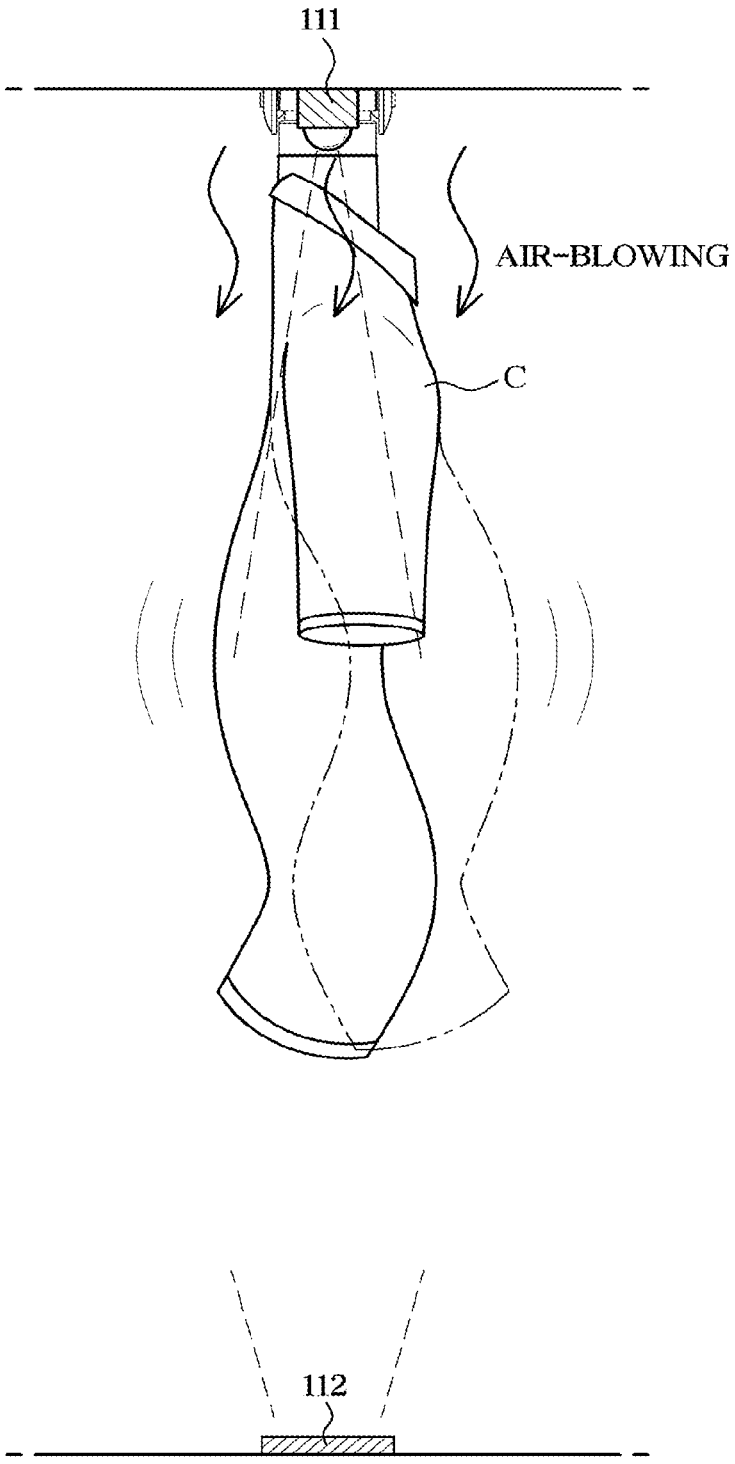
FIG. 15 is a diagram illustrating a principle that determines texture of clothes using an optical sensor by a clothes care apparatus according to an embodiment.
Figure 16:
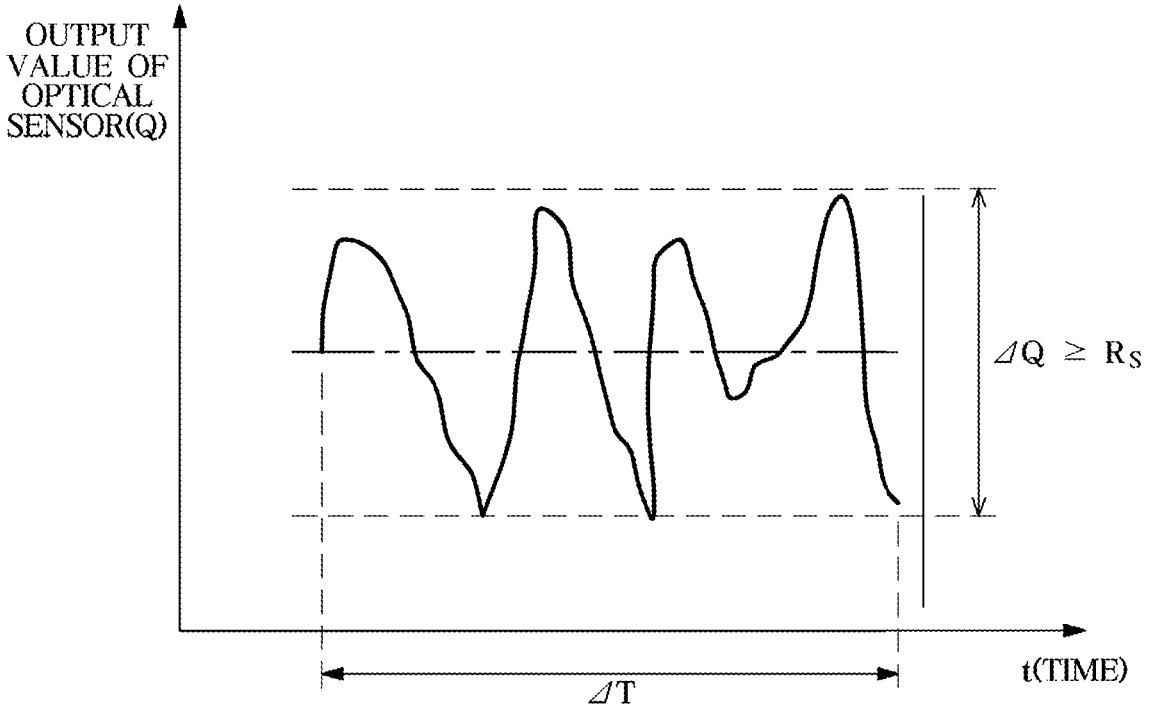
FIGS. 16 to 18 are graphs showing examples of output values of an optical sensor according to texture of clothes.
Figure 17:
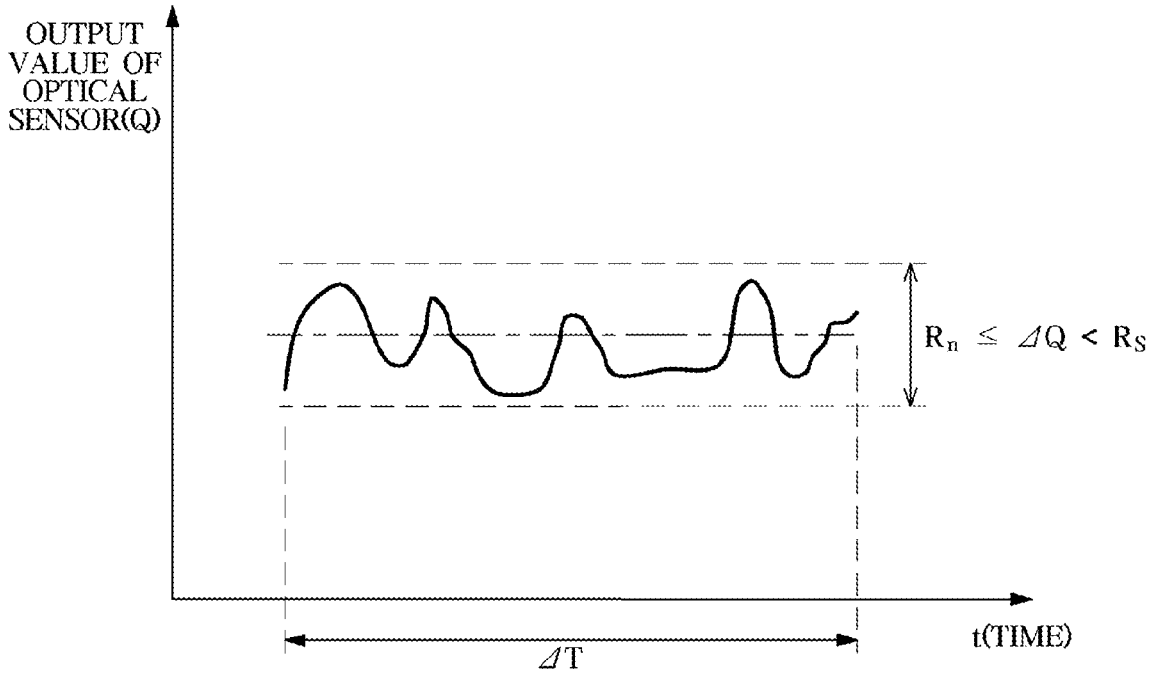
Figure 18:
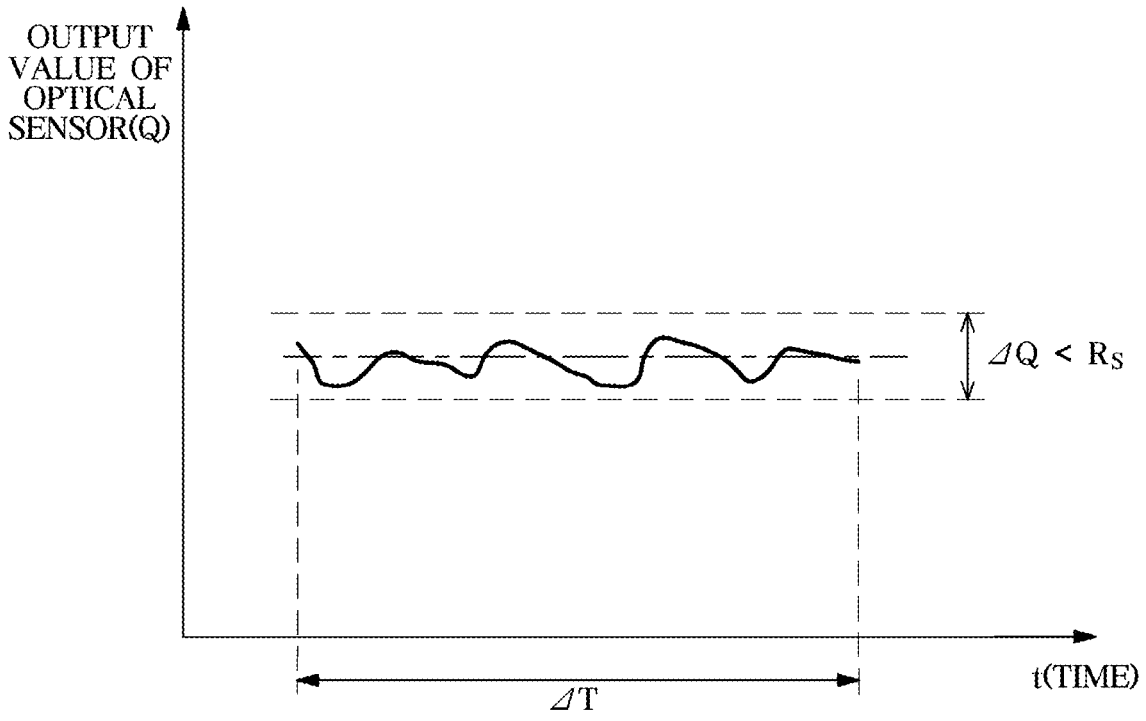

FIG. 15 is a diagram illustrating a principle determining a texture of clothes using an optical sensor by a clothes care apparatus according to an embodiment, and FIGS. 16 to 18 are graphs showing examples of output values of an optical sensor according to textures of clothes.

After clothes is accommodated in the clothes care apparatus 1, the controller 120 may control the upper blowing device 132 to generate wind, and the generated wind may be supplied into the chamber 12*a*. The generated wind is discharged to the inside of the hanger 30 and then to the both sides of the clothes mounted on the hanger 30 through the first discharge port 12*f*. Accordingly, when wind is supplied into the chamber 12*a* through the upper blowing device 132, a movement occurs in the clothes C as shown in FIG. 15. The movement of the clothes C may vary in size depending on the texture, and a movement of soft and light clothes is relatively large, and a movement of hard and heavy clothes is relatively small.

Accordingly, the controller 120 may identify the texture of the clothes on the basis of the amount of change in the output value of the optical sensor 110. As the amount of change in the output value of the optical sensor 110 is larger, the clothes may be identified as being formed of soft or light texture.

The controller 120 may store a reference value corresponding to each texture of clothes in advance, and may identify the texture of the clothes by comparing the amount of change in the output value of the optical sensor 110 with the reference value stored in advance.

For example, the following description will be made in relation to a case where the texture of clothes is classified into three types of texture including a soft texture, a medium texture, and a hard texture according to the degree of softness. As shown in FIG. 16, when the amount of change $\Delta Q$ in the output value of the optical sensor 110 measured for a predetermined time $\Delta t$ is greater than or equal to a first reference value Rs, the texture of the clothes may be determined as a soft texture. As shown in FIG. 17, when the amount of change $\Delta Q$ in the output value of the optical sensor 110 measured for a predetermined time $\Delta t$ is less than the first reference value Rs and greater than or equal to a second reference value Rh, the texture of the clothes may be determined as a medium texture. As shown in FIG. 18, when the amount of change $\Delta Q$ in the output value of the optical sensor 110 measured for a predetermined time $\Delta t$ is less than the second reference value Rh, the texture of the clothes may be determined as a hard texture.

Classifying the texture of clothes into three types of texture is merely an example, and it should be understood that the texture may be classified into two types of texture or four or more types of texture. In addition, the above-described example has been described on a case where wind is supplied through the upper blowing device 132, but the lower blowing device 131 may be used together with the upper blowing device 132.

In addition, the controller 120 may classify the texture of the clothes in more detail, such as silk, cotton, wool, wool, polyester, nylon, hair (animal hair, such as fur), etc. according to the output value of the optical sensor 110.

In addition, the controller 120 may analyze a pattern in change of the output value of the optical sensor 110 for detailed classification of the texture of clothes. For example, the controller 120 may store a pattern in change of the output value of the optical sensor 110 for each texture of clothes in advance, and compare a measured pattern in change of the output value with the pattern stored in advance to identify the texture of the clothes. The pattern in change of the output value of the optical sensor 110 according to the texture of the clothes may be obtained through experiments, statistics, learning, or the like. In addition, the learning data or pattern in change may be updated through a user's feedback, and learning data or pattern in change reflecting feedback of other users may be received through a communicator that communicates with an external server.

Meanwhile, the disclosure may employ one of the above-described examples for configuration and arrangement of the optical sensor 110 used to identify the texture of clothes. One light emitter 111 and one light receiver 112 may be provided as shown in FIGS. 4 and 8 described above, one light emitter 111 may be provided and light receivers 112*a*, 112*b*, and 112*c* may be provided for respective hangers 30*a*, 30*b*, and 30*c* as shown in FIGS. 9 and 10, and light emitters 111*a*, 111*b* and 111*c* and light receivers 112*a*, 112*b*, and 112*c* may be provided for respective hangers 30*a*, 30*b*, and 30*c* as shown in FIGS. 11 and 12.

When the light receivers 112*a*, 112*b*, and 112*c* are provided for the respective hangers 30*a*, 30*b*, and 30*c*, the texture of clothes mounted on each of the hangers 30*a*, 30*b*, and 30*c* may be individually and accurately identified. The controller 120 may control the blowing device 130 to supply wind into the chamber 12*a*, and identify the texture of clothes mounted on the first hanger 30*a* on the basis of the output value of the first light receiver 112*a*. In addition, the controller 130 may identify the texture of clothes mounted on the second hanger 30*b* on the basis of the output value of the second light receiver 112*b*, and may identify the texture of clothes mounted on the third hanger 30*c* on the basis of the output value of the third light receiver 112*c*.

In addition, when only one light emitter 111 and one light receiver 112 are provided, the points in time at which wind is blown may be controlled to be different between the hangers 30*a*, 30*b*, and 30*c* to individually identify the textures mounted on the hangers 30*a*, 30*b*, and 30*c*. In detail, the controller 120 may control the upper blowing device 132 to supply wind through the first discharge port 112*f* of the first hanger 30*a*, and may identify the texture of clothes mounted on the first hanger 30*a* on the basis of the output value of the optical sensor 110 measured for a predetermined time from the point in time when the wind is supplied.

When the measurement on the first hanger 30*a* is completed, the controller 120 may stop blowing wind to the first hanger 30*a* and control the upper blowing device 132 to supply wind through the first discharge port 112*f* of the second hanger 30*b*. The controller 120 may identify the texture of clothes mounted on the second hanger 30*b* on the basis of the output value of the optical sensor 110 measured for a predetermined time from the point in time when the wind is supplied.

When the measurement on the second hanger 30*b* is completed, the controller 120 may stop blowing wind to the second hanger 30*b* and control the upper blowing device 132 to supply wind through the first discharge port 112*f* of the third hanger 30*c*. The controller 120 may identify the texture of clothes mounted on the third hanger 30*c* on the basis of the output value of the optical sensor 110 measured for a predetermined time from the point in time when the wind is supplied.

When the light receivers 112*a*, 112*b*, and 112*c* are provided for the respective hangers 30*a*, 30*b*, and 30*c*, air blowing may be simultaneously performed on the plurality of hangers 30*a*, 30*b*, and 30*c*, or the point in time of air blowing may be controlled to be different for each hanger 30*a*, 30*b*, or 30*c* to improve the accuracy of determining the texture of clothes.

In addition, the controller 120 may simultaneously or sequentially supply wind to the plurality of hangers 30*a*, 30*b*, and 30*c* regardless of the load of clothes, but the controller 120 may determine a hanger to be subjected to air blowing on the basis of the load of clothes. For example, the controller 120, in response to acquiring information about a hanger 30 on which clothes are hung, may selectively supply wind only to the hanger 30 on which the clothes are hung. The information about the hanger 30 on which the clothes are hung may be acquired on the basis of the output value of the optical sensor 110 as described above, or may be acquired on the basis of an output value of a weight sensor (180 in FIG. 18) which will be described below.

Such an air-blowing for identifying the texture of the clothes may be performed for a predetermined time before a clothes care course starts. Alternatively, when an initial stroke of a clothes care course to be performed includes air blowing, the identifying of texture of clothes may be performed while the air blowing is being performed after the clothes care course starts. In this case, the air blowing performed for identifying the texture of the clothes may employ a blowing parameter set as a default, and after the identifying of the texture of the clothes is completed and thus a blowing parameter according to the texture of the clothes is determined, the determined blowing parameter may be employed.

The controller 120 may determine at least one of a control parameter of the blowing device 130 or a control parameter of the steam generating device 150 on the basis of the texture of the clothes accommodated in the clothes care apparatus 1. The control parameter may be determined so that clothes care, such as dust removal, wrinkle removal, odor removal, and sterilization, are optimally performed for each texture of the clothes.

For example, as the texture of the clothes is softer, the air volume, the air blowing time, the steam volume, or the steam generation time may be determined to be smaller, and as the texture of the clothes is harder, the air volume, the air blowing time, the steam volume, or the steam generation time may be determined to be larger.

When a plurality of pieces of clothes are accommodated in the clothes care apparatus 1 and the textures of the plurality of pieces of clothes are different from each other, the controller 120 may determine the control parameter of the blowing device 130 or the steam generating device 150 on the basis of the clothes having the most sensitive texture among the plurality of pieces of clothes. To this end, the controller 120 may store the rankings according to the sensitivity of texture of clothes in advance, and determine the control parameter of the blowing device 130 or the steam generating device 150 on the basis of the texture having the highest sensitivity, among the textures of pieces of clothes that are identified as being accommodated in the clothes care apparatus 1.

For example, when silk is stored with the highest sensitivity among the textures of the clothes, the controller 130, in response to silk being included in the textures of the clothes accommodated in the clothes care apparatus 1, may control the control parameter of the blowing device 130 or the control parameter of the steam generating device 150 on the basis of silk.

Alternatively, the hardness and the sensitivity are individually stored for each texture of clothes, and the control parameter of the blowing device 130 may be determined on the basis of the texture having the highest hardness, and the control parameter of the steam generating device 150 may be determined on the basis of the texture having the highest sensitivity.

Alternatively, in response to acquiring information about the load of clothes, the controller 120 may determine at least one of the control parameter of the blowing device 130 or the control parameter of the steam generating device 150 in consideration of both the load of clothes and the texture of the clothes.

Figure 19:
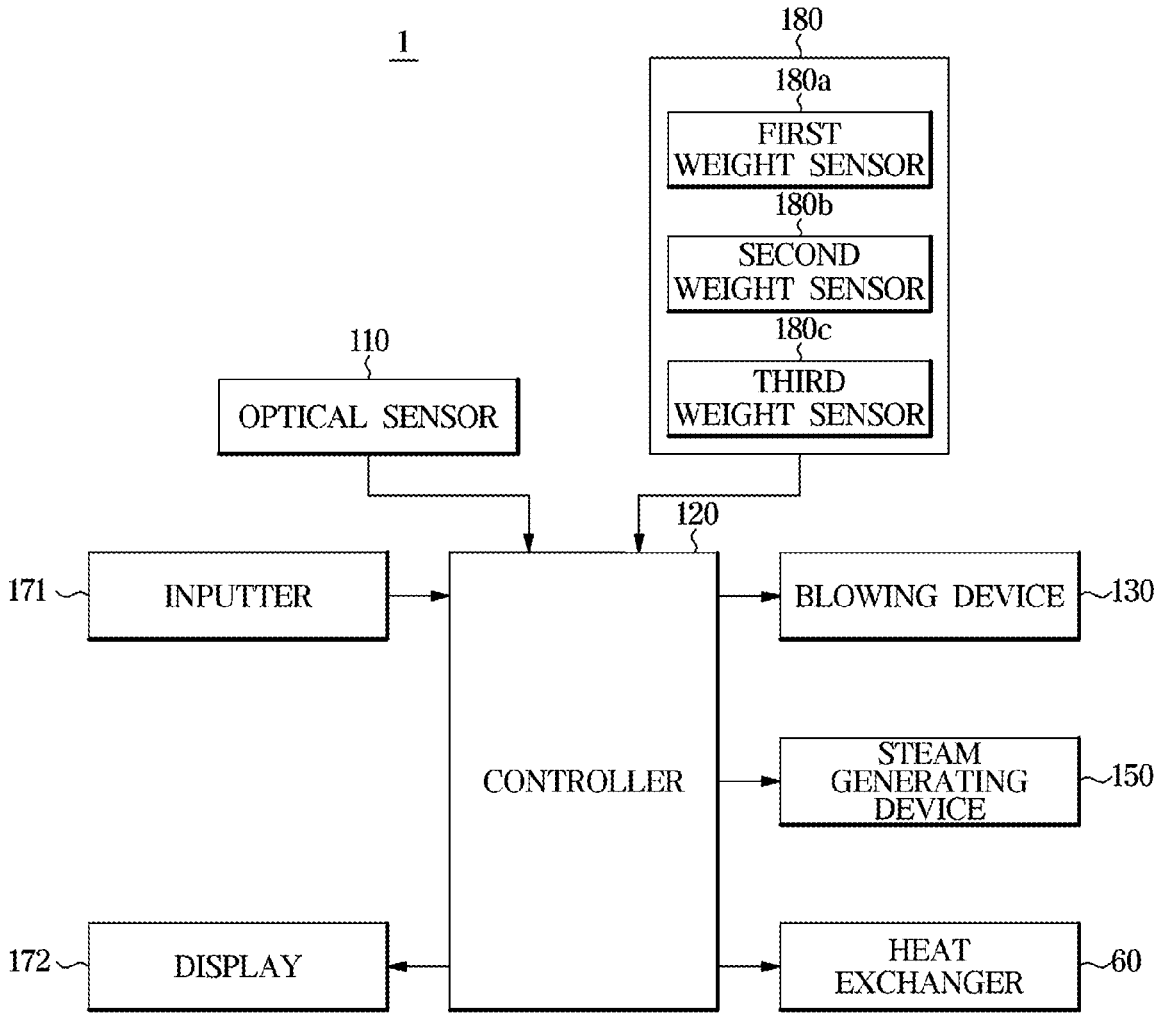
FIG. 19 is an example of a table in which control parameters are stored to correspond to a load of clothes and texture of clothes in advance.

FIG. 19 is an example of a table in which control parameters are stored to correspond to load of clothes and texture of clothes in advance.

Referring to the example of FIG. 19, the controller 120 may store control parameters corresponding to the loads and textures of clothes in the form of a table in advance, and retrieve and acquire a control parameter corresponding to a load of clothes and a texture of clothes identified on the basis of the output value of the optical sensor 110.

The control parameter stored in the table is a control parameter that enables clothes care, such as wrinkle removal, dust removal, and odor removal, to be optimally performed on clothes of the corresponding load and texture, and may be acquired through experiments, statistics, or learning, and stored. In addition, the learning data or the table may be updated through user's feedback on the satisfaction level of clothes care.

The table shown in FIG. 19 may be associated with a blowing parameter or a steam parameter, and FIG. 19 may store separate tables for a blowing parameter and a steam parameter.

Even for the same load and the same texture of clothes, an appropriate control parameter for performing optimal clothes care may vary depending on the strokes constituting the clothes care course. Accordingly, the controller 120 may store each control parameter table for each stroke constituting a clothes care course. For example, in response to a standard course among the clothes care courses, the controller 120 may store a steam parameter table for a steam stroke constituting the standard course, a blowing parameter table for a cleaning stroke constituting the standard course, and a blowing parameter table for a drying stroke constituting the standard course.

On the other hand, the controller 120 does not need to store control parameters according to the load of clothes and the texture of clothes in the form of a table, and may store control parameters in the form of a function having the load of clothes and the texture of clothes as variables as another example.

The controller 120 may control the blowing device 130 and the steam generating device 150 on the basis of the determined control parameters.

FIG. 20 is a control block diagram illustrating a clothes care apparatus further including a weight sensor.

Referring to FIG. 20, the clothes care apparatus 1 according to the embodiment may further include a weight sensor 180 that detects the weight of the hanger 30. The weight sensor 180 is arranged on each of the plurality of hangers 30*a*, 30*b*, and 30*c* to individually detect the weight of each of the hangers 30*a*, 30*b*, and 30*c*.

The controller 120 may identify whether clothes are hung on the first hanger 30*a* on the basis of an output value of the first weight sensor 180*a* arranged on the first hanger 30*a*. For example, the controller 120, in response to the output value of the first weight sensor 180*a* being greater than or equal to a preset reference value, identify that clothes are hung on the first hanger 30*a*. The preset reference value may be equal to or greater than the weight of the first hanger 30*a*.

In addition, the controller 120 may identify whether clothes are hung on the second hanger 30*b* on the basis of an output value of the second weight sensor 180*b* arranged on the second hanger 30*b*. For example, the controller 120, in response to the output value of the second weight sensor 180*b* being greater than or equal to a preset reference value, identify that clothes are hung on the second hanger 30*b*. The preset reference value may be equal to or greater than the weight of the second hanger 30*b*.

In addition, the controller 120 may identify whether clothes are hung on the third hanger 30*c* on the basis of an output value of the third weight sensor 180*c* arranged on the third hanger 30*c*. For example, the controller 120, in response to the output value of the third weight sensor 180*c* being greater than or equal to a preset reference value, identify that clothes are hung on the third hanger 30*c*. The preset reference value may be equal to or greater than the weight of the third hanger 30*c*.

The controller 120 may identify the load of clothes in the clothes care apparatus 1 on the basis of the output values of the respective weight sensors 180*a*, 180*b*, and 180*c*, and determine at least one of the blowing parameter or the steam parameter on the basis of the identified load of clothes. The operation of determining the control parameter according to the load of clothes is the same as the example described above.

Meanwhile, the controller 120 may identify not only whether clothes are hung, but also the weight of the mounted clothes, on the basis of the output value of the weight sensor 180. Therefore, in determining the control parameter, not only the total load of the clothes, but also the weight of the clothes may be considered. For example, in the case of two pieces of clothes in the total load of clothes, the blowing parameter or the steam parameter may be set to be different between a case where the total weight of clothes is 5 kg and a case where the total weight of clothes is 10 kg. Accordingly, more precise control may be performed on the blowing device 130 or the steam generating device 150.

As described above, the optical sensor 110 may be used to identify the texture of clothes, and the controller 120 may determine at least one of a blowing parameter or a steam parameter on the basis of a texture of clothes identified using the output value of the optical sensor and a load of clothes identified using the output value of the weight sensor 180.

The clothes care apparatus 1 may perform various courses for clothes care, and each clothes care course may be composed of various strokes, such as steam, cleaning, and drying. For example, the clothes care apparatus 1 may perform a clothes care course, such as a standard course, a sterilization course, and a fine dust removal course.

The clothes care course may be selected by a user manipulating the inputter 171 or may be automatically selected by the clothes care apparatus 1. When the clothes care apparatus 1 automatically selects a clothes care course, information required for the selection of the clothes care course may be acquired from a tag attached to the clothes, or may be acquired through communication with an external server.

The blowing device 130 and the steam generating device 150 may operate in a stroke including air blowing and steam generating among various strokes constituting a clothes care course. A steam stroke includes steam generation. Accordingly, the controller 120 may determine a blowing parameter to be applied to the steam stroke on the basis of at least one of a load of clothes or a texture of clothes, and control the steam generating device 150 according to the determined blowing parameter to perform the steam stroke.

In addition, a cleaning stroke and a drying stroke both include air blowing. Accordingly, the controller 120 may determine a blowing parameter to be applied to the cleaning stroke and a blowing parameter to be applied to the drying stroke on the basis of at least one of a load of clothes or a texture of clothes, and control the blowing device 130 according to the determined blowing parameters to perform the cleaning stroke and the drying stroke.

The name used to refer to each stroke may vary. Therefore, regardless of the names used to refer to strokes, a stroke including an operation of generating steam may correspond to the steam stroke according to the present disclosure, and a stroke including an operation of performing dust removal and deodorizing by operating the blowing device 130 to supply wind may correspond to the cleaning stroke according to the present disclosure, and a stroke including an operation of performing drying and dehumidifying clothes by operating the heater 132*c* and the heat exchanger 60 together with the blowing device 130 may correspond to the drying stroke according to the present disclosure.

As an example, the following description will be made in relation to a case in which the clothes care apparatus 1 performs a standard course including three step strokes of steam→cleaning→drying.

Before starting the standard course, the controller 120 identifies the load of clothes accommodated in the chamber 12*a* on the basis of the output value of the optical sensor 110. In addition, the controller 120 operates the blowing device 130 for a predetermined time to supply wind to the chamber 12*a*, and identifies the texture of the clothes accommodated in the chamber 12*a* on the basis of the amount of change in the output value of the optical sensor 110.

The controller 120 may determine a steam parameter to be applied to the steam stroke, a blowing parameter to be applied to the cleaning stroke, and a blowing parameter to be applied to the drying stroke on the basis of the load of the clothes and the texture of the clothes. As an example, the table of FIG. 20 described above may be used.

In the steam stroke, the controller 120 may control the steam generating device 150 according to the determined steam parameter to generate steam. The generated steam may be supplied into the chamber 12*a* to remove wrinkles from the clothes and separate odor particles attached to the clothes.

In the cleaning stroke, the controller 120 may control the lower blowing device 131 and the upper blowing device 132 according to the blowing parameter determined for the cleaning stroke to supply wind into the chamber 12*a*. The wind supplied into the chamber 12*a* may separate dust attached to the clothes.

Air in the chamber 12*a* may contain dust separated from clothes and floating, and the air in the chamber 12*a* may be introduced into the first upper duct 13 by the wind supplied by the blowing device 130. The dust filter provided on the first upper duct 13 may collect the dust contained in the introduced air. As such, the dust in the chamber 12*a* may be removed to prevent the dust separated from the clothes from being attached to the clothes again.

In addition, air in the chamber 12*a* may contain odor particles separated from clothes, and the odor decomposition filter provided on the first upper duct 13 decomposes odor particles contained in the introduced air with light energy (ultraviolet, UV). As such, odor particles remaining in the clothes care apparatus 1 may be removed to prevent odor from being permeated into the clothes again.

In the drying stroke, the controller 120 may control the lower blowing device 131 and the upper blowing device 132 according to the blowing parameter determined for the drying stroke. In this case, the controller 120 may operate the heater 132*c* together with the heat exchanger 60 to supply hot air to the chamber 12*a* and remove moisture in the chamber 12*a*, thereby dehumidifying air and drying clothes. On the other hand, even in the drying stroke, separation of dust attached to the clothes, and collection of dust and removal of odor by filters may be partially performed.

Even in a case of performing another clothes care course, control parameters applied to respective strokes may be determined on the basis of the load and texture of clothes as described above.

The clothes care course performed by the clothes care apparatus 1 may be composed of various strokes according to a design change. The above described configuration of strokes of the standard course is merely an example, and the embodiment of the clothes care apparatus 1 is not limited thereto. The strokes may be executed in a reverse order, different from the above example, and some stokes may be added or omitted.

Figure 21:
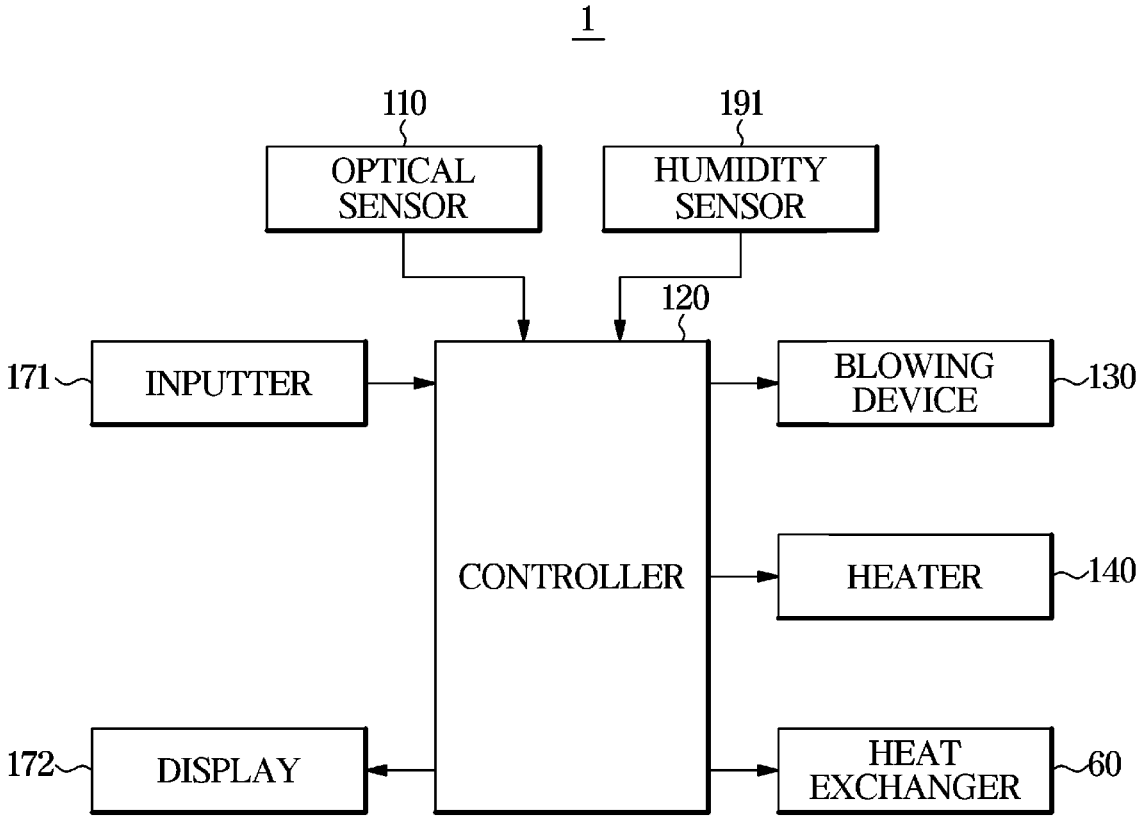
FIG. 21 is a control block diagram illustrating a clothes care apparatus further including a humidity sensor.
Figure 22:
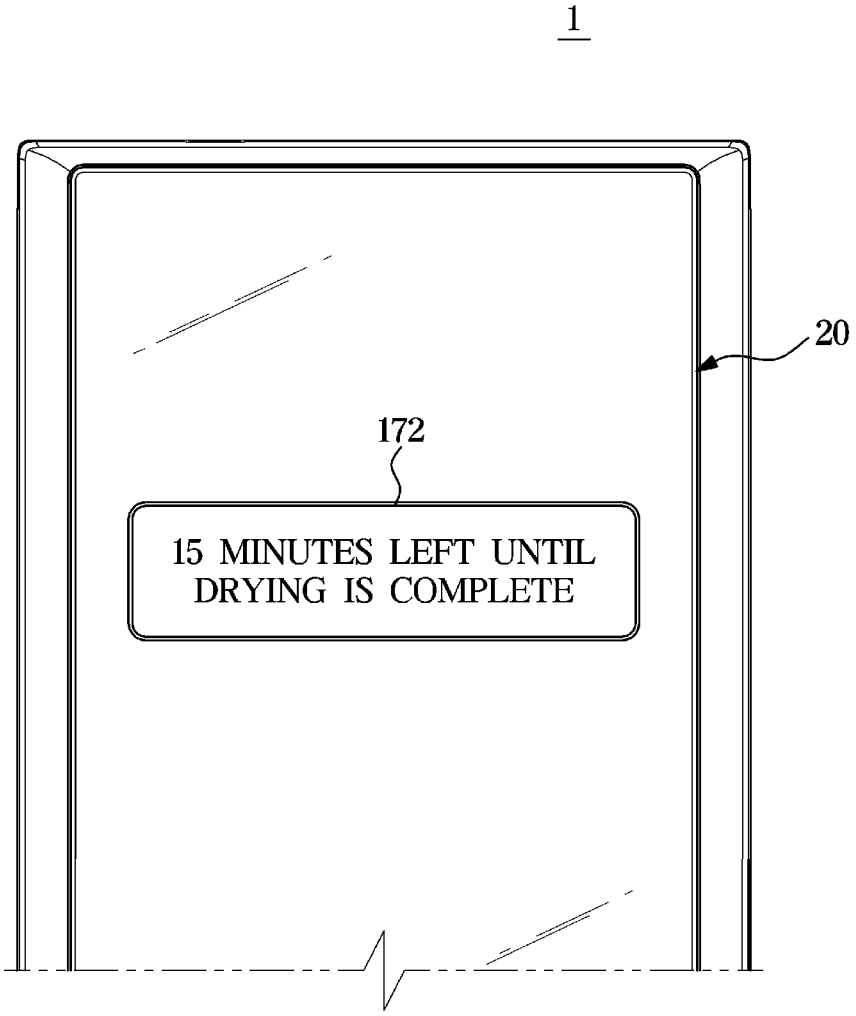
FIG. 22 is a diagram illustrating an example that displays information about a stroke end point in time.

FIG. 21 is a control block diagram illustrating a clothes care apparatus further including a humidity sensor, and FIG. 22 is a diagram illustrating an example displaying information about a stroke end point in time.

Referring to FIG. 21, the clothes care apparatus 1 according to the embodiment may further include a humidity sensor 191 that detects a humidity in the chamber 12*a*. In the example, the optical sensor 110 may be used to identify at least one of a load or a texture of clothes accommodated in the clothes care apparatus 1.

In addition, the clothes care apparatus 1 including the humidity sensor 191 may further include a weight sensor 180. In this case, the weight sensor 180 may be used to determine the load of clothes, and the optical sensor 110 may be used to determine the texture of the clothes.

The humidity sensor 191 may be arranged in an inner lower portion of the door 20, on a lower surface of the chamber 12*a*, or in the vicinity of the second inlet port 53. However, the position of the humidity sensor is not limited to the lower surface of the chamber 12*a* or in the vicinity of the second inlet port, and may be provided at various positions.

The humidity sensor 191 may perform detection starting from the end of the steam stroke and continue detecting in real time or periodically until the drying stroke ends. As needed, the detection may be started after the power of the clothes care apparatus 1 is turned on.

The controller 120, after the steam stroke ends and before the drying stroke starts, may determine an air volume and an air blowing time to be applied to the drying stroke on the basis of the output value of the humidify sensor 191.

When the controller 120 identifies the load or texture of clothes on the basis of the output value of the optical sensor 110, the steam parameter and the blowing parameter to be applied to the steam stroke and the cleaning stroke may be determined on the basis of the load of the clothes or the texture of the clothes, and the blowing parameter to be applied to the drying stroke may be determined on the basis of the output value of the humidity sensor 191.

Alternatively, even when determining the blowing parameter to be applied to the drying stroke, the controller 120 may consider the load or texture of the clothes together with the output value of the humidity sensor 191.

Alternatively, the controller 120 may determine the blowing parameter to be applied to the drying stroke on the basis of the load or texture of the clothes, and when controlling an end point in time of the drying stroke described below, may use the output value of the humidity sensor 191.

The controller 120 may provide the user with information about the determined air blowing time. Specifically, the controller 120 may predict the end point in time of the drying stroke on the basis of the determined air blowing time, and display the predicted end point in time on the display 172 as shown in FIG. 22.

The controller 120 may control the blowing device 130 according to the determined air volume and air blowing time to perform a drying stroke.

The controller 120 may monitor the output value of the humidity sensor 191 even during the drying stroke, and may determine the end point in time of the drying stroke on the basis of the amount of change in the output value of the humidity sensor 191.

For example, when the output value of the humidity sensor 191 gradually decreases and the amount of change in the output value of the humidity sensor 191 becomes zero or becomes less than a preset reference value, the controller 120 may turn off the blowing device 130 to terminate the drying stroke. Therefore, when the amount of change in the output value of the humidity sensor 191 becomes zero or less than the preset reference value before reaching the predicted end point in time of the drying stroke, the drying stroke may be terminated earlier than predicted, and when the amount of change in the output value of the humidity sensor 191 does not become zero or exceeds the preset reference value even after reaching the predicted end point in time of the drying stroke, the drying stroke may be extended. That is, the drying time is not fixed, but is flexibly controlled according to the actual humidity value in the chamber 12*a*, so that the time required for clothes care may be shortened or the clothes may be prevented from being insufficiently dried.

Figure 23:
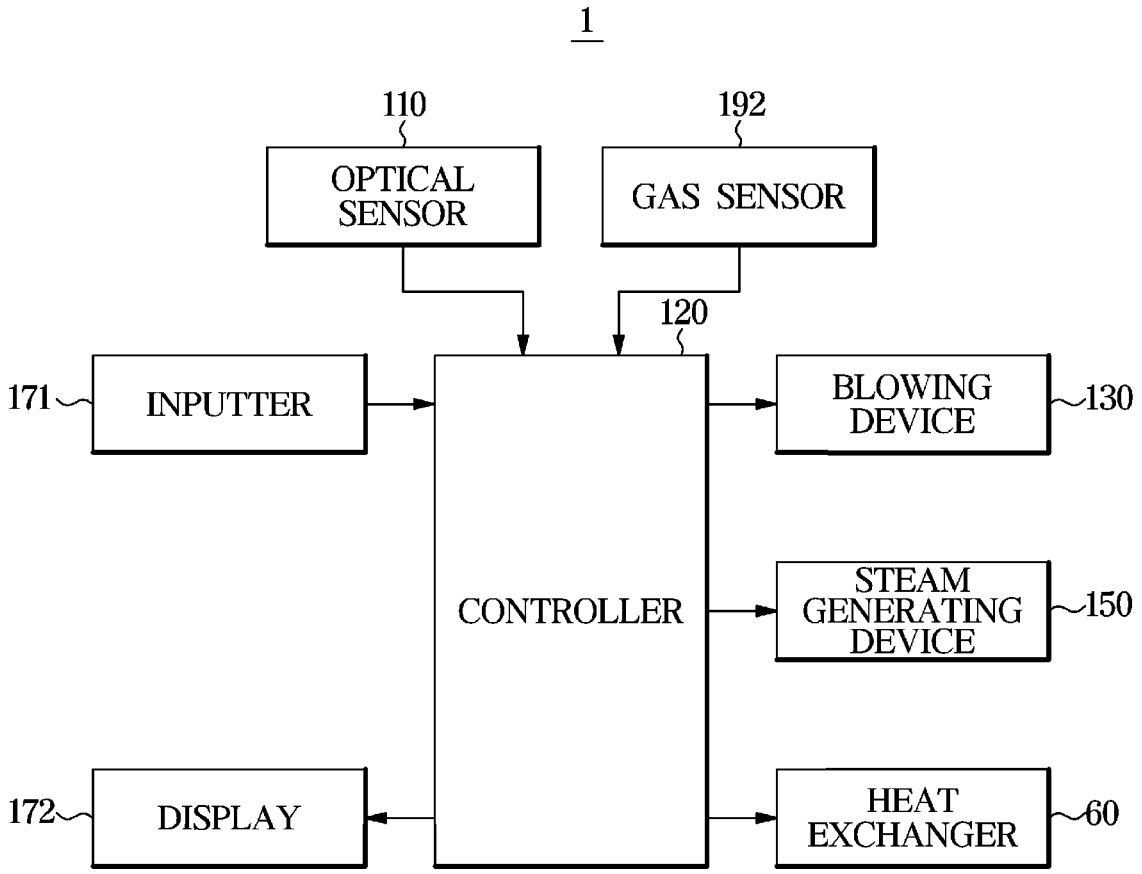
FIG. 23 is a control block diagram illustrating a clothes care apparatus further including a gas sensor.

FIG. 23 is a control block diagram illustrating a clothes care apparatus further including a gas sensor.

Referring to FIG. 23, the clothes care apparatus 1 according to an embodiment may further include a gas sensor 192 that detects gas existing in the chamber 12*a*. For example, the gas sensor 192 may be a sensor that detects the concentration of a volatile organic compound or a sensor that selectively detects the concentration of a specific gas.

In the present example, the optical sensor 110 may be used to identify at least one of a load or texture of clothes accommodated in the clothes care apparatus 1.

In addition, the clothes care apparatus 1 including the gas sensor 192 may further include a weight sensor 180. In this case, the weight sensor 180 may be used to identify a load of the clothes, and the optical sensor 110 may be used to identify a texture of the clothes.

The gas sensor 192 may be arranged in an inner lower portion of the door 20, on a lower surface of the chamber 12*a*, or in the vicinity of the second inlet port 53. However, the position of the gas sensor is not limited to the lower surface of the chamber 12*a* or in the vicinity of the second inlet, and may be provided at various positions.

Deodorization for removing odors permeated into clothes may be performed through a process of separating odor particles from clothes and decomposing the separated odor particles using an odor decomposition filter. The separating of odor particles from clothes may be performed through a steam stroke, and the decomposing of the separated odor particles may be performed by decomposing odor particles in the air blown by the blowing device 130 into the first upper duct 13 using the odor decomposition filter. Therefore, with respect to a standard course including a steam stroke, a cleaning stroke, and a drying stroke, the deodorization through decomposition of odor particles may be performed by air blowing performed during the cleaning stroke. In addition, the deodorization may be partially performed by air blowing performed during the drying stroke.

However, as described above, the standard course including the steam, cleaning, and drying strokes is only an example of a clothes care course that may be performed in the clothes care apparatus 1, and a deodorization stroke may be separately included aside from the cleaning or drying stroke. Accordingly, in the example to be described below, a stroke of introducing air in the chamber 12*a* into the odor decomposition filter by operating the blowing device 130 will be referred to as a deodorization stroke. Depending on the design of the course or the method of distinguishing strokes of the course, the deodorization stroke may be performed concurrently with the cleaning stroke or the drying stroke (when the deodorization stroke is substantially the same as the cleaning or drying stroke), or the deodorization stroke may be performed separately from the cleaning stroke or drying stroke.

The controller 120 may determine the air volume and the air blowing time to be applied to the deodorization stroke on the basis of the output value of the gas sensor 192. In this case, the load of the clothes or the texture of the clothes may also be considered, and when the above-described humidity sensor 191 is included in the clothes care apparatus 1 and the deodorization stroke is the same as the drying stroke, the output value of the humidity sensor 191 may also be considered to determine the air volume and the air blowing time.

Alternatively, the controller 120 may determine the blowing parameter to be applied to the deodorization stroke on the basis of the load of clothes or the texture of the clothes, and when controlling the end point in time of the deodorization stroke to be described below, may use the output value of the gas sensor 192.

As in the example of FIG. 22 described above, the controller 120 may display the predicted end point in time on the display 172.

The controller 120 may monitor the output value of the gas sensor 192 in real time or periodically even while the deodorization stroke is in progress, and determine the end point in time of the deodorization stroke on the basis of the amount of change in the output value of the gas sensor 192.

For example, when the output value of the gas sensor 192 gradually decreases and the amount of change in the output value of the gas sensor 192 becomes zero or becomes less than a preset reference value, the controller 120 may turn off the blowing device 130 to terminate the deodorization stroke. Therefore, when the amount of change in the output value of the gas sensor 192 becomes zero or less than the preset reference value before reaching the predicted end point in time of the deodorization stroke, the deodorization stroke may be terminated earlier than predicted, and when the amount of change in the output value of the gas sensor 192 does not become zero or exceeds the preset reference value even after reaching the predicted end point in time of the deodorization stroke, the deodorization stroke may be extended. That is, the deodorization time is not fixed, but is flexibly controlled according to the actual gas level in the chamber 12*a*, so that the time required for clothes care may be shortened or the clothes may be prevented from being insufficiently deodorized.

On the other hand, when the deodorization stroke and the drying stroke are the same as each other, the deodorization stroke may be terminated when both the amount of change in the output value of the humidity sensor 191 and the amount of change in the output value of the gas sensor 192 become zero or less than the respective preset reference values. Here, the reference value for the amount of change in the output value of the humidity sensor 191 and the reference value for the amount of change in the output value of the gas sensor 192 may be individually set.

Hereinafter, an embodiment of a method of controlling a clothes care apparatus will be described. The above-described clothes care apparatus 1 may be used for the method of controlling the clothes care apparatus according to the embodiment. Accordingly, the descriptions of FIGS. 1 to 23 above may be applied to the method of controlling the clothes care apparatus unless otherwise mentioned.

Figure 24:
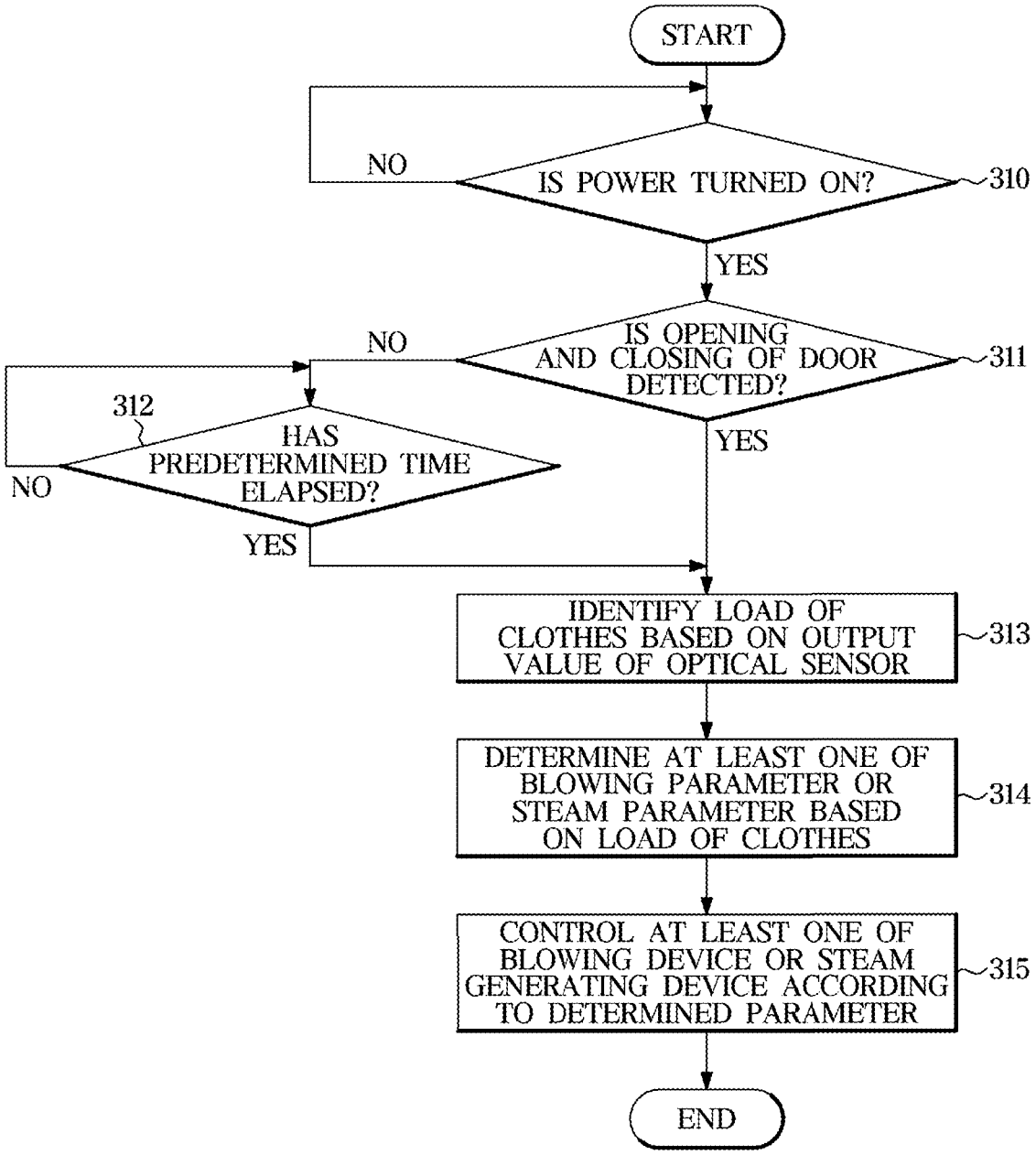
FIG. 24 is a flowchart of a method of controlling a clothes care apparatus according to an embodiment, which shows an example determining a load of clothes.

FIG. 24 is a flowchart of a method of controlling a clothes care apparatus according to an embodiment, which shows an example of determining a load of clothes.

Referring to FIG. 24, when the power of the clothes care apparatus 1 is turned on (YES in operation 310), and the opening and closing of the door 20 is detected (YES in operation 311), it is determined that clothes has been inserted. The load of the clothes may be identified on the basis of the output value of the optical sensor 110 (313).

The optical sensor 110 may perform detection starting from powering on the clothes care apparatus 1 and continue detecting until the load of clothes is identified. Description of the arrangement and operation of the optical sensor 110 is the same as that of FIGS. 4 to 14.

In addition, without detecting the opening and closing of the door 20 (NO in operation 311), when a predetermined time elapses (YES operation in 312), the load of clothes may be identified on the basis of the output value of the optical sensor 110 (313). In this case, it may be estimated that the clothes has been input before the power of the clothes care apparatus 1 is turned on. In addition, the above described various points in time of determining the load of clothes of the clothes care apparatus 1 may also be applied to the embodiment of the method of controlling the clothes care apparatus.

As described above, the output value of the optical sensor 110 varies according to the number of pieces of clothes accommodated in the chamber 12*a*. For example, the controller 120 may store loads of clothes to correspond to output values of the optical sensor 110 in advance, and identify a load of clothes stored to correspond to an output value of the optical sensor 110 as a current load of the clothes accommodated in the clothes care apparatus 1.

The controller 120 may determine at least one of a blowing parameter or a steam parameter on the basis of the identified load of the clothes (314). The blowing parameter may include at least one of an air volume or an air blowing time, and the steam parameter may include at least one of a steam volume or a steam generation time.

Meanwhile, before or after the load of clothes is identified, a clothes care course may be selected, and the controller 120 may determine a blowing parameter or a steam parameter on the basis of the selected clothes care course. For example, when both a steam stroke and a blowing stroke are included in the selected clothes care course, the controller 120 may determine both the blowing parameter and the steam parameter, and when the selected clothes care course does not include a steam stroke, the controller 120 may determine only the blowing parameter.

The controller 120 may control at least one of the blowing device 130 or the steam generating device 150 according to the determined parameter (315).

Figure 25:
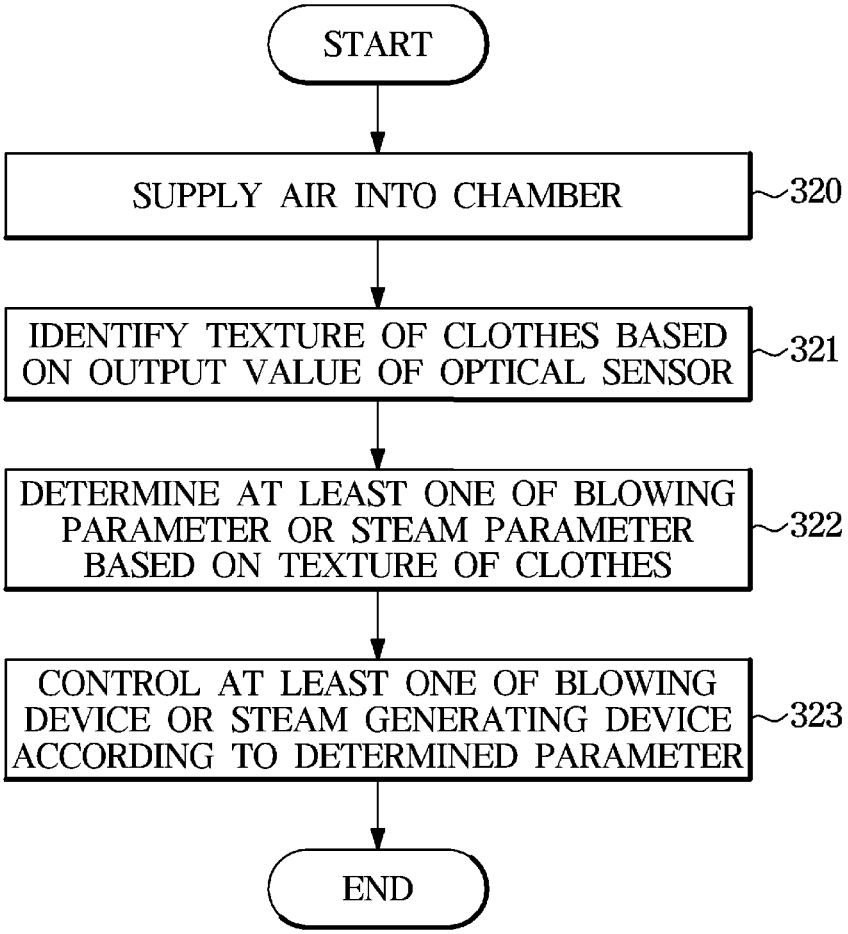
FIG. 25 is a flowchart of a method of controlling a clothes care apparatus according to an embodiment, which shows an example determining a texture of clothes.

FIG. 25 is a flowchart of a method of controlling a clothes care apparatus according to an embodiment, which shows an example determining a texture of clothes.

Referring to FIG. 25, the controller 120 controls the blowing device 130 to supply wind into the chamber 12*a* (320). In response to the initial stroke of the selected clothes care course corresponding to a blowing stroke, air-blowing may be performed during execution of the initial stroke of the clothes care course, and in response to the initial stroke of the selected clothes care course not corresponding to a blowing stroke, separate air-blowing for identifying the texture of the texture may be performed prior to the execution of the clothes care course.

When wind is supplied into the chamber 12*a*, a movement occurs in the clothes mounted on the hanger 30, and the output value of the optical sensor 110 is subject to change according to the movement of the clothes. Accordingly, the controller 120 may identify the texture of the clothes on the basis of the output value of the optical sensor 110 (321). Specifically, the controller 120 may identify the texture of the clothes on the basis of the amount of change in the output value of the optical sensor 110. As the amount of change in the output value of the optical sensor 110 is great, it may be identified that the clothes is formed of a soft or light texture.

For example, the controller 120 may store a reference value corresponding to each texture of clothes in advance, and may identify a texture of clothes by comparing the amount of change of the output value of the optical sensor 110 with the reference value stored in advance. Description of the operation of identifying the texture of the clothes is the same as the description of FIGS. 16 to 18 described above.

On the other hand, the optical sensor 110 may start detection after powering on of the clothes care apparatus 1, and continue detecting until the texture of the clothes is identified, or may start detection after air-blowing starts in the chamber 12*a*. Description of the arrangement and operation of the optical sensor 110 is the same as that of FIGS. 4 to 12.

At least one of the blowing parameter or the steam parameter may be determined on the basis of the texture of the clothes (322), and at least one of the blowing device 130 or the steam generating device 150 may be controlled according to the determined parameter (323). As described above, the controller 120 may determine the blowing parameter or the steam parameter on the basis of the selected clothes care course. For example, when a steam stroke and a blowing stroke are both included in the selected clothes care course, both the blowing parameter and the steam parameter may be determined, and when the selected clothes care course does not include a steam stroke, only the blowing parameter may be determined.

When a plurality of pieces of clothes are accommodated in the clothes care apparatus 1 and the textures of the plurality of pieces of clothes are different from each other, the controller 120 may determine the blowing parameter or the steam parameter on the basis of the clothes formed of the most sensitive texture among the plurality of pieces of clothes. Description thereof is the same as that described above in the embodiment of the clothes care apparatus 1.

Meanwhile, the method of controlling the clothes care apparatus according to an embodiment may include determining a load of clothes and determining a texture of clothes. In this case, before supplying wind into the chamber 12*a*, the load of clothes may be identified according to the example of FIG. 22, and after supplying wind into the chamber 12*a*, the texture of the clothes may be identified according to the example of FIG. 23. However, in this case, both the load of clothes and the texture of clothes may be considered in determining the blowing parameter or the steam parameter. Description of the operation of determining the blowing parameter or the steam parameter on the basis of the load of clothes and the texture of clothes is the same as that of FIG. 20 described above.

In the case where the method of controlling the clothes care apparatus according to the embodiment includes both the determining of the load of clothes and the determining of the texture of clothes, both the load of clothes and the texture of clothes may be identified using the optical sensor 110 according to the example of FIGS. 4 to 12, or the texture of clothes may be identified using the optical sensor 110 according to the example of FIGS. 4 to 12 and the load of clothes may be identified using the weight sensor 180 according to the example of FIG. 20.

Figure 26:
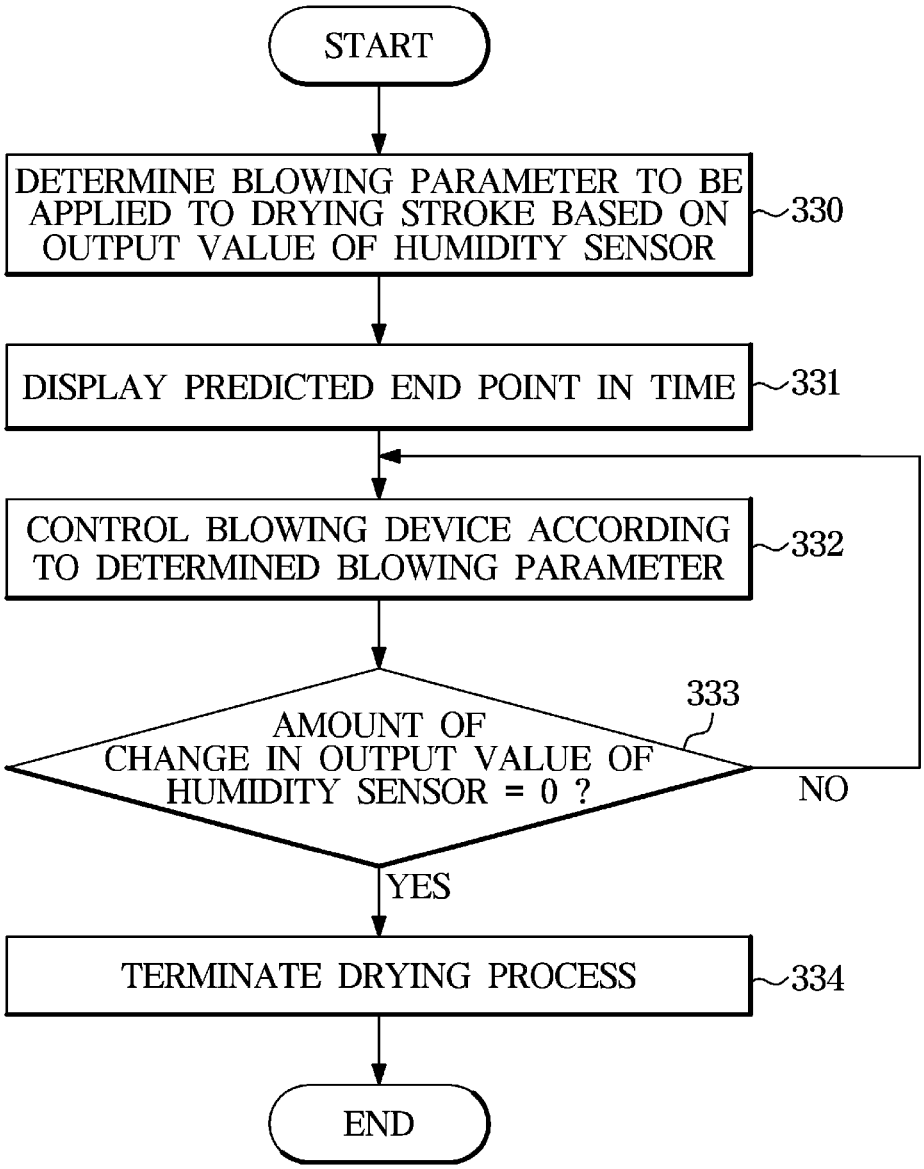
FIG. 26 is a flowchart of a method of controlling a clothes care apparatus according to an embodiment, which shows an example determining a stroke end point in time on the basis of an output value of a humidity sensor.

FIG. 26 is a flowchart of a method of controlling a clothes care apparatus according to an embodiment, which shows an example determining an end point in time of a stroke on the basis of an output value of a humidity sensor.

Referring to FIG. 26, when the method of controlling the clothes care apparatus according to the embodiment is applied to a clothes care course including a steam stroke and a drying stroke, the controller 120, after the steam stroke ends and before the drying stroke starts, determines a blowing parameter to be applied to the drying stroke on the basis of the output value of the humidity sensor 191 (330). The humidity sensor 191 may perform detection starting from the end of the steam stroke and continue detecting in real time or periodically until the drying stroke ends.

In addition, in determining the blowing parameter, the load of clothes or the texture of clothes may also be considered.

The controller 120 may predict the end point in time of the drying stroke on the basis of the determined air blowing time, and may display the predicted end point in time on the display 172 (331).

The controller 120 may control the blowing device 130 according to the determined blowing parameter (332) to perform the drying stroke.

The controller 120 may monitor the output value of the humidity sensor 191 during the drying stroke, and may determine the end point in time of the drying stroke on the basis of the amount of change in the output value of the humidity sensor 191.

For example, when the output value of the humidity sensor 191 gradually decreases and the amount of change in the output value of the humidity sensor 191 becomes zero (YES in operation 333), the controller 120 may terminate the drying stroke even before reaching the predicted end point in time (334). In this manner, the stroke execution time may be efficiently managed. Alternatively, even when the amount of change in the output value of the humidity sensor 191 is not zero, but is less than a reference value, the blowing device 130 may be turned off to terminate the drying stroke.

In addition, the controller 120 may continue performing the drying stroke in response to the amount of change in the output value of the humidity sensor 191 not becoming zero (NO in operation 333) even when the predicted end point in time elapses, to prevent the stroke from being terminated with the clothes insufficiently dried.

Figure 27:
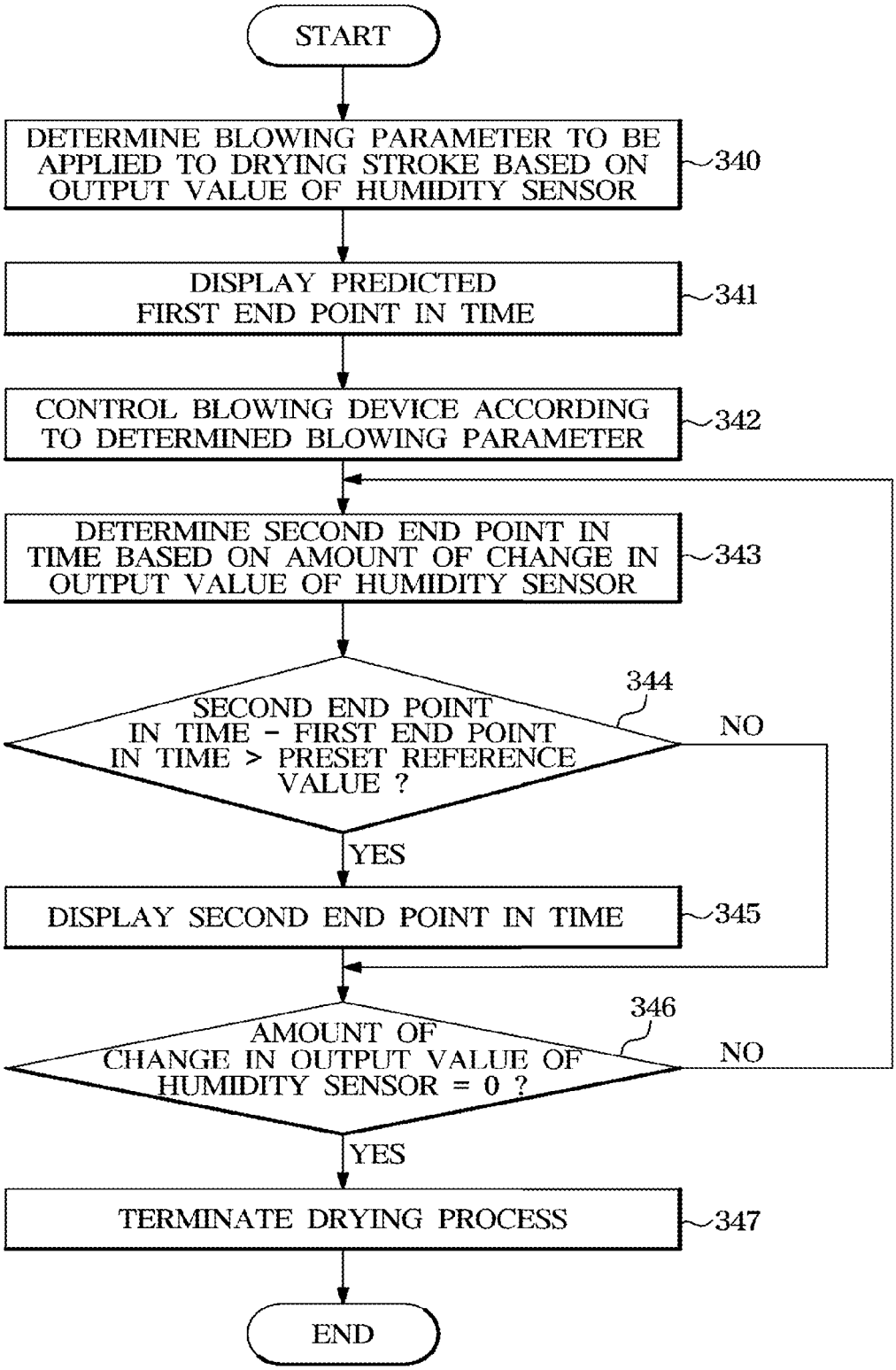
FIG. 27 is a flowchart of a method of controlling a clothes care apparatus according to another embodiment, which shows an example determining a stroke end point in time on the basis of an output value of a humidity sensor.

FIG. 27 is a flowchart of a method of controlling a clothes care apparatus according to another embodiment, which shows an example determining an end point in time of a stroke on the basis of an output value of a humidity sensor.

Specifically, the clothes care apparatus according to the embodiment may monitor a changing trend in the output value while collecting the output value of the humidity sensor 191. Specifically, the clothes care apparatus may identify that an end point in time predicted when a drying stroke starts is different from a point in time predicted again during the drying stroke, and may change the end point in time.

Referring to FIG. 27, when the method of controlling the clothes care apparatus according to the embodiment is applied to a clothes care course including a steam stroke and a drying stroke, the controller 120, after the steam stroke ends and before the drying stroke starts, determines a blowing parameter to be applied to the drying stroke on the basis of the output value of the humidity sensor 191 (340). The humidity sensor 191 may perform detection starting from the end of the steam stroke and continue detecting in real time or periodically until the drying stroke is terminated.

Even in this case, when determining the blowing parameter, the load of clothes and the texture of clothes may also be considered.

The controller 120 may predict a first end point in time of the drying stroke on the basis of the determined air blowing time, and may display the predicted first end point in time on the display 172 (341).

The controller 120 may control the blowing device 130 according to the determined blowing parameter (342) to perform the drying stroke.

The controller 120 may monitor the output value of the humidity sensor 191 even during the drying stroke, and may determine the end point in time of the drying stroke again on the basis of the amount of change in the output value of the humidity sensor 191 (343).

For example, as shown in FIGS. 16 to 18, the controller 120 may collect the optical sensor output value and observe a change trend in the output value. The controller 120 may identify the amount of change $\Delta Q$ in the measured output value for a predetermined time $\Delta t$, and predict a point in time (hereinafter, referred to a second end point in time) at which the amount of change $\Delta Q$ in the measured output value is likely to become zero on the basis of the amount of change $\Delta Q$ in the measured output value after the predetermined time $\Delta t$.

The controller 120 calculates a difference between the second end point in time and the first end point in time. For example, the first end point in time may be predicted as fifteen minutes as shown in FIG. 22. At the same time, the controller 120 may predict the second end point in time as twenty minutes on the basis of the trend of the amount of change. The controller 120 compares the difference between the second end point in time and the first end point in time with a preset reference value (344).

In response to the difference between the second end point in time and the first end point in time exceeding the preset reference value, the controller 120 displays the second end point in time during the drying stroke (345). With such a configuration, the clothes care apparatus according to the embodiment reports the changed predicted end point in time of the drying stroke to the user, thereby increasing the user's convenience.

In response to the difference between the second end point in time and the first end point in time not exceeding the preset reference value (NO in operation 344), the controller 120 continues monitoring the output value of the humidity sensor 191.

When the output value of the humidity sensor 191 gradually decreases and the amount of change in the output value of the humidity sensor 191 becomes zero (YES in operation 346), the controller 120 may terminate the drying stroke (347).

In addition, the controller 120, in response to the amount of change in the output value of the humidity sensor 191 not becoming zero (NO in operation 333), may continue the drying stroke even when the predicted end point in time elapses, to prevent the stroke from being terminated in a state in which the clothes are insufficiently dried.

Meanwhile, the reference value applied to the embodiment in which the second end point in time is newly displayed may vary, and the reference value may be changed by the user.

Figure 28:
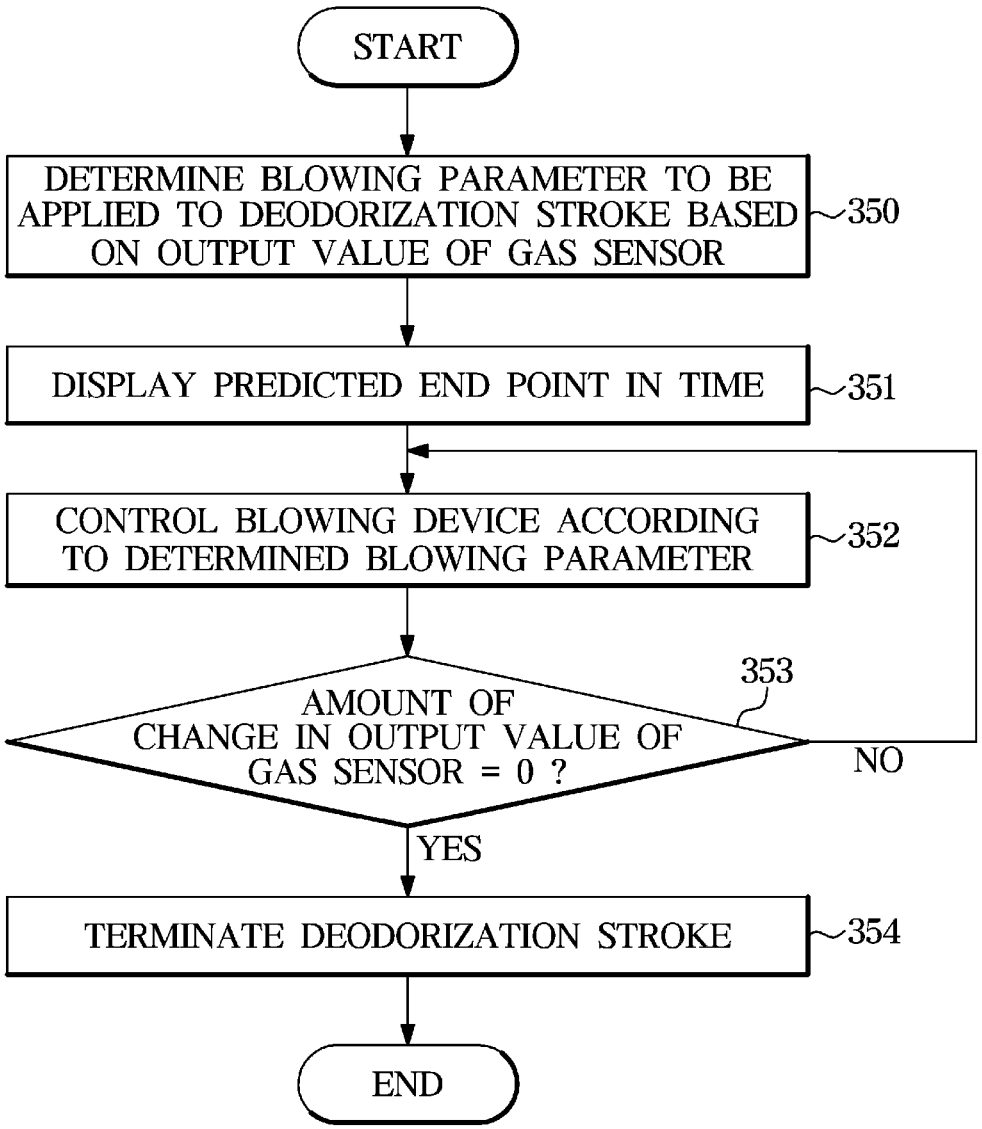
FIG. 28 is a flowchart of a method of controlling a clothes care apparatus according to an embodiment, which shows an example determining a stroke end point in time on the basis of an output value of a gas sensor.

FIG. 28 is a flowchart of a method of controlling a clothes care apparatus according to an embodiment, which shows an example determining an end point in time of a stroke on the basis of an output value of a gas sensor.

Referring to FIG. 28, when the method of controlling the clothes care apparatus according to the embodiment is applied to a clothes care course including a deodorization stroke, the controller 120 determines a blowing parameter to be applied to the deodorization stroke on the basis of the output value of the gas sensor 192 before the deodorization stroke starts (350). The gas sensor 192 may start detection before the deodorization stroke starts and continue detecting in real time or periodically until the deodorization stroke ends.

In addition, in determining the blowing parameter, the load or texture of clothes may also be considered.

The controller 120 may predict the end point in time of the deodorization stroke on the basis of a determined air blowing time, and may display the predicted end point in time on the display 172 (351).

The controller 120 may control the blowing device 130 according to the determined blowing parameter (352) to perform the deodorization stroke.

The controller 120 may monitor the output value of the gas sensor 192 even during the deodorization stroke, and may determine the end point in time of the deodorization stroke on the basis of the amount of change in the output value of the gas sensor 192.

For example, when the output value of the gas sensor 192 gradually decreases and the amount of change in the output value of the gas sensor 192 becomes zero (YES in operation 353), the controller 120 may terminate the deodorization stroke even before reaching the predicted end point in time (354). In this manner, the stroke execution time may be efficiently managed. Alternatively, even in response to the amount of change not zero but less than a reference value, the blowing device 130 may be turned off to terminate the deodorization stroke.

In addition, the controller 120, in response to the amount of change in the output value of the gas sensor 192 not becoming zero (NO in operation 353) even while the predicted end point in time has elapsed, may continue the deodorization stroke, to prevent the stroke from being terminated in a state in which clothes is insufficiently deodorized.

On the other hand, when the clothes care apparatus 1 includes both the humidity sensor 191 and the gas sensor 192, and the deodorization stoke and the drying strokes are performed at the same time, both the output value of the humidity sensor 191 and the output value of the gas sensor 192 may be considered when determining the blowing parameter. In this case, when the amount of change in the output value of the humidity sensor 191 and the amount of change in the output value of the gas sensor 192 are both zero or less than a preset reference value, the deodorization stroke may be terminated.

Although embodiments of the present disclosure have been described with reference to the accompanying drawings, those skilled in the art will appreciate that these inventive concepts may be embodied in different forms without departing from the scope and spirit of the disclosure, and should not be construed as limited to the embodiments set forth herein.

The invention claimed is:

1. A clothes care apparatus comprising:

a chamber configured to accommodate clothes;

at least one hanger disposed in the chamber on which the clothes are hung;

an optical sensor including a light emitter and a light receiver;

a blowing device configured to supply wind into the chamber;

a steam generating device configured to supply steam into the chamber; and at least one processor configured to:

control the blowing device to supply air into the chamber, identify a texture of clothes accommodated in the chamber on the basis of an amount of change in an output value of the optical sensor measured during the supply of the wind into the chamber, determine a control parameter of at least one of the blowing device or the steam generating device on the basis of the texture of the clothes, and control the at least one of the blowing device or the steam generating device on the basis of the determined control parameter.

2. The clothes care apparatus of claim 1, wherein the at least one processor further configured to identify a number of pieces of clothes accommodated in the chamber on the basis of an amount of light received by the light receiver.

3. The clothes care apparatus of claim 1, wherein the control parameter of the blowing device includes at least one of an air volume or an air blowing time.

4. The clothes care apparatus of claim 1, wherein the control parameter of the steam generating device includes at least one of a steam volume or a steam generating time.

5. The clothes care apparatus of claim 1, wherein the hanger includes a first hanger and a second hanger, and the optical sensor includes a first optical sensor provided to correspond to the first hanger and a second optical sensor provided to correspond to the second hanger.

6. The clothes care apparatus of claim 5, wherein the at least one processor configured to identify whether clothes are hung on the first hanger on the basis of an output value of the first optical sensor, and identify whether clothes are hung on the second hanger on the basis of an output value of the second optical sensor.

7. The clothes care apparatus of claim 1, wherein the hanger includes a first hanger and a second hanger, and the light receiver includes a first light receiver arranged to correspond to the first hanger and a second light receiver arranged to correspond to the second hanger.

8. The clothes care apparatus of claim 7, wherein the at least one processor configured to identify whether clothes are hung on the first hanger on the basis of an output value of the first light receiver, and identify whether clothes are hung on the second hanger on the basis of an output value of the second light receiver.

9. The clothes care apparatus of claim 1, wherein the light emitter and the light receiver are arranged on an upper portion of the chamber, and a reflective film that reflects light is attached to the hanger.

10. The clothes care apparatus of claim 1, wherein one of the light emitter and the light receiver is arranged on an upper portion of the chamber, and a remaining one of the light emitter and the light receiver is arranged on a lower portion of the chamber.

11. The clothes care apparatus of claim 1, wherein the at least one processor further configured to identify a load of the clothes accommodated in the chamber on the basis of the output value of the optical sensor.

12. A method of controlling a clothes care apparatus, the method comprising:

controlling a blowing device to supply air into a chamber;

identifying a texture of clothes accommodated in the chamber on the basis of an amount of change in an output value of an optical sensor;

determining at least one of a control parameter of a blowing device for supplying wind into the chamber or a control parameter of a steam generating device for supplying steam into the chamber on the basis of the texture of the clothes; and controlling the at least one of the blowing device or the steam generating device on the basis of the determined at least one of the control parameter of the blowing device or the control parameter of the steam generating device.

13. The method of claim 12, further comprising:

identifying a load of the clothes accommodated in a chamber on the basis of the output of the optical sensor.

14. The method of claim 13, wherein the determining of the at least one of the control parameter of the blowing device or the control parameter of the steam generating device includes determining at least one of the control parameter of the blowing device or the control parameter of the steam generating device on the basis of the load of the clothes and the texture of the clothes.

* * * * *